US005427258A

United States Patent [19]

Krishnakumar et al.

[11] Patent Number: 5,427,258

[45] Date of Patent: Jun. 27, 1995

[54] FREESTANDING CONTAINER WITH IMPROVED COMBINATION OF PROPERTIES

[75] Inventors: Suppayan M. Krishnakumar, Nashua; Wayne N. Collette, Merrimack, both of N.H.

[73] Assignee: Continental PET Technologies, Inc., Florence, Ky.

[21] Appl. No.: 31,045

[22] Filed: Mar. 26, 1993

Related U.S. Application Data

[63] Continuation-in-part of Ser. No. 866,136, Apr. 9, 1992, abandoned.

[51] Int. Cl.[6] ..... B65D 23/00

[52] U.S. Cl. ..... 215/400; 220/606; 220/608; 220/609; 220/633; 264/523

[58] Field of Search ..... 215/1 C; 220/606, 608, 220/609, 633; 264/523, 532

[56] References Cited

U.S. PATENT DOCUMENTS

| | | |
|---|---|---|
| 3,598,270 | 8/1971 | Adomaitis et al. . |
| 3,718,229 | 2/1973 | Wyeth et al. . |
| 3,727,783 | 4/1973 | Carmichael . |
| 3,778,214 | 12/1973 | Wyeth et al. . |
| 3,849,530 | 11/1974 | Wyeth et al. . |
| 3,871,541 | 3/1975 | Adomaitis . |
| 3,881,621 | 5/1975 | Adomaitis . |
| 3,935,955 | 2/1976 | Das . |
| 4,108,324 | 8/1978 | Krishnakumar et al. . |
| 4,134,510 | 1/1979 | Chang . |
| 4,249,667 | 2/1981 | Pocock et al. . |
| 4,261,948 | 4/1981 | Krishnakumar et al. . |
| 4,267,144 | 5/1981 | Collette et al. . |
| 4,294,366 | 10/1981 | Chang . |
| 4,334,627 | 6/1982 | Krishnakumar et al. . |
| 4,335,821 | 6/1982 | Collette et al. . |
| 4,355,728 | 10/1982 | Yoshino et al. . |
| 4,436,216 | 3/1984 | Chang . |
| 4,525,401 | 6/1985 | Pocock et al. . |
| 4,725,464 | 2/1988 | Collette . |
| 4,755,404 | 7/1988 | Collette . |
| 4,780,257 | 10/1988 | Beck . |
| 4,785,949 | 11/1988 | Krishnakumar et al. . |
| 4,785,950 | 11/1988 | Miller et al. . |
| 4,850,493 | 7/1989 | Howard, Jr. . |
| 4,850,494 | 7/1989 | Howard, Jr. . |
| 4,865,206 | 9/1989 | Behm et al. . |
| 4,867,323 | 9/1989 | Powers . |
| 4,892,205 | 1/1990 | Powers et al. . |
| 4,927,680 | 5/1990 | Collette et al. . |
| 4,978,015 | 12/1990 | Walker . |
| 5,024,340 | 6/1991 | Alberghini et al. . |
| 5,064,080 | 11/1991 | Young et al. . |
| 5,139,162 | 8/1992 | Young et al. . |
| 5,160,059 | 11/1992 | Collette et al. . |

FOREIGN PATENT DOCUMENTS

| | | |
|---|---|---|
| 37948/89 | 1/1990 | Australia . |
| 0225155 | 6/1987 | European Pat. Off. . |
| 0237196 | 9/1987 | European Pat. Off. . |
| 0244128 | 11/1987 | European Pat. Off. . |
| 1571499 | 6/1969 | France . |
| 6920207 | 5/1969 | Germany . |
| 2218167 | 11/1972 | Germany . |
| 2414945 | 10/1975 | Germany . |
| 2920122 | 11/1980 | Germany . |
| 2098167 | 11/1982 | United Kingdom . |
| WO-86/05462 | 9/1986 | WIPO . |

OTHER PUBLICATIONS

Research Disclosure, Mar. 1986.

*Primary Examiner*—Allan N. Shoap

*Assistant Examiner*—Stephen Cronin

*Attorney, Agent, or Firm*—Wolf, Greenfield and Sacks

[57] ABSTRACT

A freestanding container base having an improved combination of properties in regard to creep resistance, stress crack resistance, impact strength, weight, standing stability and formability. The container base has a substantially hemispherical bottom wall which includes four radiating ribs, and four legs extending downwardly from the bottom wall between the ribs and each of which terminates in a foot. Each rib has a rib wall forming part of the substantially hemispherical bottom wall and having an angular extent of from about 15° to about 30° for enhanced strength, with the leg occupying the remaining 75° to 60° angular extent for enhanced formability. The outer edge and angular extent of the foot are predetermined for enhanced stability and ease of formability. Preferably, the creep resistance is further enhanced by straightening the upper rib portion or providing an enlarged-diameter truncated bottom wall. The base is particularly suited for a blown PET carbonated beverage bottle.

32 Claims, 18 Drawing Sheets

CL
R
θ
U

| θ | K | Ø |
|---|---|---|
| 35 | 1.283 | 51.23 |
| 40 | 1.204 | 56.17 |
| 50 | 1.105 | 64.92 |
| 60 | 1.049 | 72.41 |
| 70 | 1.019 | 78.95 |

FREESTANDING CONTAINER WITH IMPROVED COMBINATION OF PROPERTIES

This application is a continuation-in-part of application Ser. No. 07/866,136 filed Apr. 9, 1992, now abandoned.

BACKGROUND OF THE INVENTION

This invention relates to freestanding containers, and more particularly to a freestanding carbonated beverage bottle having a footed base which provides an improved balance of properties in regard to creep resistance, stress crack resistance, impact strength, weight, standing stability and formability.

Over the last twenty years, the container industry for carbonated soft drinks has converted almost in its entirety from glass bottles to lightweight plastic bottles. The evolution of these plastic bottles during that time period has been significant, and a review thereof highlights the critical balance of properties required for producing a commercially successful bottle today.

The 1960's initiated an era of diversification for metal and glass container suppliers into the relatively new, but promising flexible and semi-rigid plastic container market. Through development and/or acquisition, companies like Continental Can Company, Owens Illinois and Sewell developed extrusion blow molding operations to produce high density polyethylene, polypropylene and polyvinyl chloride containers for the growing consumer food and household chemical markets.

At this time enormous growth was occurring in the carbonated soft drink (CSD) industry and was being met exclusively by glass (in larger container sizes) and metal (in smaller container sizes) suppliers because the commercially-available polymers of the period did not offer the critical balance of properties required for carbonated beverages. As such, chemical companies, equipment suppliers and container manufacturers initiated plastic CSD development programs in the late 1960's and identified the following basic criteria as necessary elements in large (i.e., 1, 2 and 3 liter) plastic containers for the soft drink market:

- glasslike clarity
- adequate $CO_2$ barrier retention
- resistance to volume expansion (i.e., creep) under pressure
- no adverse influence on product taste and/or additive migration into the soft drink
- significantly improved impact shatter resistance vs. glass
- overall economics to permit delivered selling prices equal to or preferably lower than glass.

Two polymer material candidates were developed in the early 1970's. Monsanto focused on polyacrylonitrile/styrene copolymer (ANS) containers produced via a two-stage parison extrusion blow and subsequent reheat stretch blow mold process. DuPont focused on polyethylene terephthalate (PET) containers produced via a two-stage preform injection molding and subsequent reheat stretch blow mold process.

Monsanto's ANS bottle made by an extrusion blow process and having an integral champagne base was first commercially marketed (by Coca-Cola in a 32 oz. size) in 1974. Although adequate for clarity, barrier and creep resistance, the bottle exhibited poor drop impact performance, poor economics vs. glass, and was subsequently banned by the U.S. Food and Drug Administration (FDA) in 1976 after migration studies showed the presence of residual acrylonitrile monomer in the beverage after relatively short storage periods. Although controversial, the ban effectively eliminated ANS as a competitor and left PET as the only viable beverage bottle material.

DuPont created polyethylene terephthlate (PET) as a synthetic substitute for silk fiber during World War II. Initial commercial applications were as fibers and flexible films. The polymer was subsequently FDA approved in 1952. PET's clarity, sparkling cleanliness, low cost and excellent strain hardening, orientation and crystallization characteristics expanded its market penetration throughout the 1960's into medical and photographic film, thermoformed semi-rigid wide mouth packages, and other products. In the late 1960's a DuPont chemist, J. Wyeth, brother of Andrew Wyeth the painter, conceived the two-stage preform injection molding and subsequent reheat stretch blow process resulting in the now famous Wyeth U.S. Pat. No. 3,718,229 of 1973. DuPont enlisted Cincinnati Millicron, a machine supplier, in a joint venture to develop and commercialize the new process.

In parallel to these resin developments, Continental Can Company ("Continental") focused on the establishment of low cost conversion systems and container designs. Continental early on targeted a freestanding single material design as a critical element in a low-cost plastic CSD container. It was projected that over time an optimized one-piece design would produce containers faster and with a lower total resin cost and at a reduced overall capital investment vs. two-piece designs (i.e., those utilizing a bottom supporting member or "base cup" of a separate molded polymer). The Adomaitis patent (U.S. Pat. No. 3,598,270) granted to Continental in 1971 disclosed the world's first plastic free standing looted pressurized plastic container, now known as the "PETalite" container.

In the 1970's, Continental focused on a two-liter container design, anticipating correctly the CSD industry's desire to upsize "family" packages beyond that safely achieveable with glass (one-liter maximum). In 1976, Continental commercialized the first six-foot PETalite (one-piece) two-liter PET bottles for Coke and Pepsi. All remaining PET suppliers (Owens Illinois, Sewell, and Hoover Universal (now JCI), etc.) chose to develop two-piece (bottle and base cup) containers.

The new PET beverage bottles, both one and two-piece, were an immediate commercial success as consumers favored the light weight, large size, shatterproof safety and convenience over competitive glass bottles. By 1982, virtually all of the glass CSD packages above 16 ounces had been displaced by PET.

The 1980's saw significant increases in productivity and reductions in container weight and selling price for all sizes, both one and two-piece constructions. Several key technical improvements were commercialized by Continental to improve the viability of one-piece CSD containers in the marketplace, including:

1) In the early 1980's, the initial 70 gram preform was redesigned to optimize orientation levels and hoop-/axial orientation balance. These improvements permitted lightweighting without a loss of bottle creep/stress crack performance utilizing the initial 1976 PETalite base design.
2) During this same time period, efforts to enhance container production rates and maximize graphic space (i.e., label size) on PETalite containers resulted in the commercialization of the improved containers described in Continental's U.S. Pat. Nos. 4,249,667, 4,267,144 and 4,335,821. The '667 patent modified the base hemisphere design to decrease creep by adding straight line sections, producing a reduced base height which also maximized the label panel height (important for marketing purposes). The '144 and '821 patents reduced the mold cooling time by geometrical modifications to the central dome area, above the plane of the feet. All of these enhancements were successfully commercialized without increasing base creep and/or reducing environmental stress crack (ESC) resistance.

3) The advent of rotary re-heat stretch blow molding machines in the mid-1980's (via Krupp of Germany and Sidel of France) led to dramatic increases in production rates and consistency of material distribution in the bottle sidewall. The latter permitted a weight reduction to 58 grams with the same basic PETalite base design introduced in 1976.

Further lightweighting attempts below 58 grams were halted when test market containers exhibited unacceptable levels of environmental stress crack (ESC) initiation and occasional propogation through the bottle sidewall (i.e., yielding unacceptable field leakers). ESC generation is a relatively complex phenomenon that occurs when low orientation regions of a PET container are exposed to high levels of stress (due to internal pressurization) in the presence of stress crack initiation agents, such as line lubricants (utilized on the filling line), moisture, corrugate, shelf cleaning agents (utilized by grocery stores), etc. Highly biaxially oriented PET, such as that in the bottle sidewall regions, is extremely resistant to ESC formation. However, the lack of stretch induced crystallization in the low orientation, highly stressed regions of a freestanding base can initiate chemical attack on the exterior surface (which is in tension when pressurized), micro-cracking, and under severe conditions, crack propogation through the container wall.

To address this ESC concern, Continental undertook a development program to redesign/improve the original PETalite base to permit further lightweighting. Several critical elements to the overall commercial success of a freestanding base were considered:

ease of formability (processability)

line handling stability (empty and filled)

low stress generation and balanced stress distribution (i.e., minimal creep and no high stress concentration points when pressurized)

efficient use of materials (i.e., lightweight)

no adverse impact on productivity (i.e., minimum mold cooling requirements).

After significant development efforts, a five-foot base design was achieved, as described in Krishnakumar U.S. Pat. No. 4,785,949, which issued in 1988. The five-foot retained the basic foot design of the original PETalite base, but with a significant increase in the rib area defined by the hemispherical bottom wall, and further allowed a 4 gram weight reduction. A 54 gram, two-liter five-foot bottle was commercialized having improved field performance in substantially all respects over the original six-foot PETalite (Adomaitis '270) base design.

In the late 1980's, other competitors, recognizing the cost disadvantages of the two-piece design and the significant recycling advantages of the PETalite approach, initiated one-piece development efforts of their own. A freestanding PET bottle patent was issued to Owens Illinois as Chang U.S. Pat. No. 4,294,366. The Chang patent describes a generally elliptical (rather than a generally hemispherical) transverse cross section through the rib area. The hemispherical approach, however, is preferred as it provides improved geometrical resistance to deformation under pressure (i.e., creep) vs. an ellipse. Owens Illinois ultimately exited the CSD PET market and as such, the Chang '366 base was never successfully commercialized.

Powers U.S. Pat. No. 4,867,323 issued in 1989 to Hoover Universal (now JCI) and focused primarily on maximizing the foot pad width and diameter for improved line handling. However, narrow U-shaped ribs provided high stress concentration areas and susceptibility to stress cracking. The low rib cross-sectional area yielded poor resistance to bottom deformation under pressure, yielding excessive height growth and product fill point drop (i.e., the appearance of low fills on the store shelves). The '323 container was never successfully commercialized.

Behm U.S. Pat. No. 4,865,206 issued in 1989 again to Hoover (now JCI), and attempted to improve on the '323 patent by increasing the number of ribs from three to five, thus increasing the rib area and reducing the pressure deformation (creep), albeit to a limited degree. Again, however, foot size is stressed over rib width and base creep remains a problem. In fact, to accommodate the creep problem an angled design is provided for the foot pads which move downward under pressure into the foot "plane" as the base itself deforms outwardly. The deep, wide foot pads themselves are difficult to form and most commercial bottles show evidence of underformation (potential rockers) and/or stress whitening (visual defect due to overstretching/cold stretching). Although marketed in the U.S.A., the relatively heavy 56.5 gram two-liter container is found only in the cooler latitudes where ESC problems are less of a concern (lower temperatures produce lower stress levels and reduce ESC propogation).

Walker U.S. Pat. No. 4,978,015 issued in 1990 to North American Container, and once again focused primarily on line handling stability by maximizing the foot pad contact area. Base creep and ESC resistance are severaly compromised by the narrow, sharply radiused "U-shaped" inverted ribs. When commercialized this design would be expected to exhibit poor formability and inferior thermal performance in warm climates.

There have been numerous other proposed designs for freestanding carbonated beverage containers, e.g., U.S. Pat. Nos. 3,727,783 (Carmichael), 5,024,340 (Alberghini), 5,024,339 (Riemer) and 5,139,162 (Young et al.), but none of these has achieved an improved combination of properties nor been the commercial success of the Krishnakumar five-foot design.

Despite the success of the Krishnakumar five-foot design, Continental has continued developmental activities to further optimize freestanding PETalite container technology. These efforts have produced the new container base design of this invention.

SUMMARY OF THE INVENTION

In accordance with this invention, an improved freestanding container base and method of designing the same is provided, the base having a superior combination of properties in regard to creep resistance, stress crack resistance, impact strength, lightweight, standing stability, and formability.

Surprisingly, the improved combination of properties has been found to exist for a container having a substantially hemispherical bottom wall with four radiating ribs symmetrically positioned about a vertical centerline of the container, and wherein the ribs and interposed legs and feet occupy select positions in the bottom wall. In contrast, the prior art has generally preferred an odd number of feet, and often a rather large number of feet, e.g., seven or more. Reducing the number of feet or using an even number was disfavored because of stability problems. However, in this invention the stability problem is overcome and also there is an improvement in strength and formability.

The improved combination of properties is best illustrated in FIGS. 21–25 wherein the four-foot container of this invention is compared to certain three, five and six foot containers each having a lesser combination of properties. In these graphical illustrations, the angular extent of the leg, B, gives an indication of the "formability", wherein the ease of formability increases with increasing B, i.e., the larger the angular extent of the leg, the easier it is to properly form the leg and foot. The strength of the container, which affects the creep resistance and stress crack resistance is represented in these graphs by the total angular extent of the ribs, $T_R$ or alternatively by the load carrying angular extent $\Psi_L$. The strength increases with increasing $T_R$ and $\Psi_L$. The stability is represented in these graphs by the tip length $T_L$, with an increasing value of $T_L$ corresponding to an increase in stability. By graphing various combinations of the strength, stability and formability, wherein two of the parameters are varied and the third held constant, it is clear that a container having four feet according to this invention is superior to containers having three, five or six feet.

The container base of this invention has a substantially hemispherical bottom wall which includes four radiating ribs, and four legs extending downwardly from the bottom wall between the ribs and each of which terminates in a foot. Each rib has a rib wall forming part of the substantially hemispherical bottom wall and the angular extent of the ribs may be increased for greater strength, while the feet are moved outwardly for greater stability. The base strength (creep resistance) and formability may be maximized in the four-foot base design of this invention for a given standing stability, compared to a five- or three-foot base design. Also, the base strength of the four-foot design is greater than that of a five- or three-foot design at varying levels of standing stability.

In one aspect of the invention, the angular extent of the ribs is maximized in order to increase the creep resistance, such that each rib has an angular extent of from about 15° to about 30°, and more preferably about 20° to about 25°. Where lower cost is a factor, the angular extent of the ribs is increased in order to increase the strength, while the rib thickness is decreased in order to produce a lighter weight container (i.e., less material equals a less expensive product). In this case, the lowest allowable fill line would be maintained. By way of example, a reduction in weight with the four-foot base design of this invention makes possible a 50–52 gram two-liter PET beverage bottle with an improved balance of properties. Alternatively, if it is desired to minimize any drop in fill line (i.e., minimize creep), then the rib area, both angular extent and thickness, may be increased; this would require more material and thus be more expensive.

In a further aspect of the invention for reducing the amount of creep, the shape of the bottom wall is modified from a pure hemisphere to a reduced base height. In a first embodiment, a substantially hemispherical base is provided having in cross section a pure hemispherical lower portion and a straight-line upper rib portion, which straight-line portion reduces the volume expansion at the upper rib and thus reduces the drop in fill line. The resulting reduction in base height enables a reduction in weight (less material required), and/or the use of a thicker rib for greater strength, and/or an increase in the angular extent of the leg for greater stability and/or blow moldability. In a second embodiment, a reduction in creep is achieved by providing a substantially hemispherical bottom wall with a radius greater than that of the cylindrical panel portion above the base. The result is a truncated base at the upper rib which similarly reduces volume expansion due to creep at the upper rib. Still further, the reduced base height may incorporate both of these embodiments.

In another aspect of the invention, an improved balance of properties may be obtained, rather than maximization of any one property. For example, the rib cross-sectional area and foot pad cross-sectional area and placement may be selected to provide somewhat greater strength, greater stability and less weight (rather than maximizing any one of the three properties). In general, an improvement in impact strength must be balanced against an improvement in creep resistance and/or an improvement in stability. The improved creep resistance and stress crack resistance make this base design particularly suitable for returnable or refillable containers. These and other aspects of the invention will be more fully described in the following drawings and detailed description.

DETAILED DESCRIPTION

Figure 1:
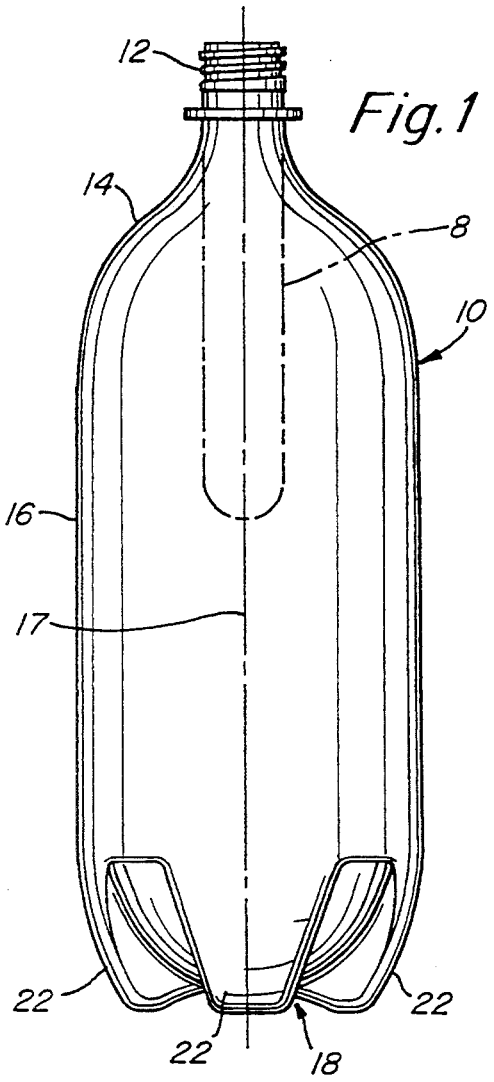
FIG. 1 is a front elevational view of a bottle having a four-foot base configuration according to this invention.
Figure 2:
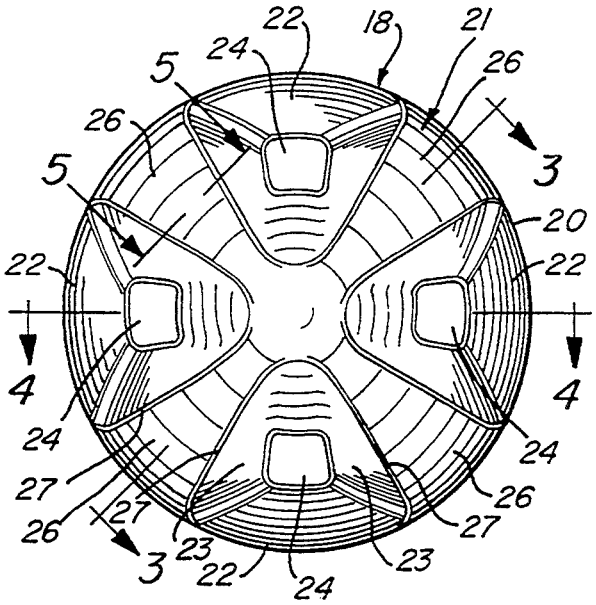
FIG. 2 is a bottom view of the base of FIG. 1.

FIGS. 1 and 2 show a preferred four-foot bottom end structure according to this invention as incorporated in a representative two-liter plastic bottle 10. The bottle is suitable for carbonated beverages, such as a soft drink carbonated to at least 4 atm (at room temperature). Although such bottles represent a principal application of this invention, it will be understood that the invention is applicable to containers generally.

The bottle 10 is an integral hollow body formed of a biaxially-orientable thermoplastic resin, such as polyethylene terephthalate (PET), and is blow molded from an injection-molded preform 8 (shown in dashed lines) having an upper thread finish 12. Below the thread finish, the bottle 10 includes a tapered shoulder portion 14, a cylindrical panel portion 16 (defined by vertical axis or centerline 17), and an integral base portion 18.

Figure 5A:
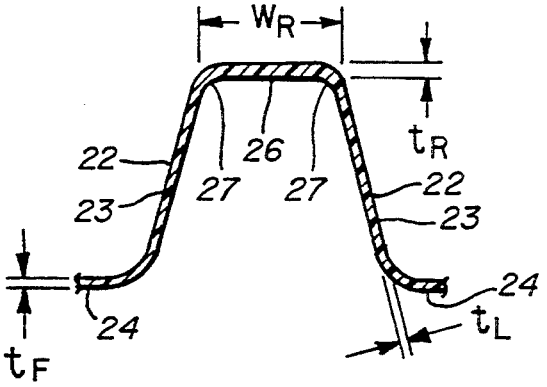
FIGS. 5(*a–c*) is an enlarged fragmentary view taken along the section lines 5–5 of FIG. 2, showing a horizontal (radial) cross section of one of the ribs and adjacent leg sidewalls.
Figure 5B:
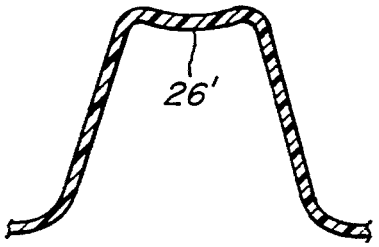
Figure 5C:
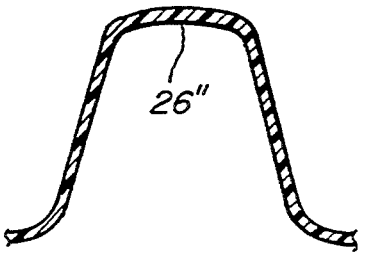

As shown in FIG. 2, the base 18 has a circular outline or circumference 20 of diameter 4.45", which is the diameter of the panel portion 16 into which the upper edge of the base is smoothly blended. The base 18 includes a substantially hemispherical bottom wall 21 with four symmetrically-spaced and downwardly-projecting legs 22, each of which terminates in a lowermost foot 24. Between each pair of legs 22 is disposed a rib having a substantially flat rib wall 26 (see the radial cross-section of FIG. 5*a*), which rib wall 26 which forms part of the substantially hemispherical bottom wall 21. The rib wall 26 may be slightly bowed outwardly (26" in FIG. 5*b*), or slightly bowed inwardly (26" in FIG. 5C).

Figure 3:
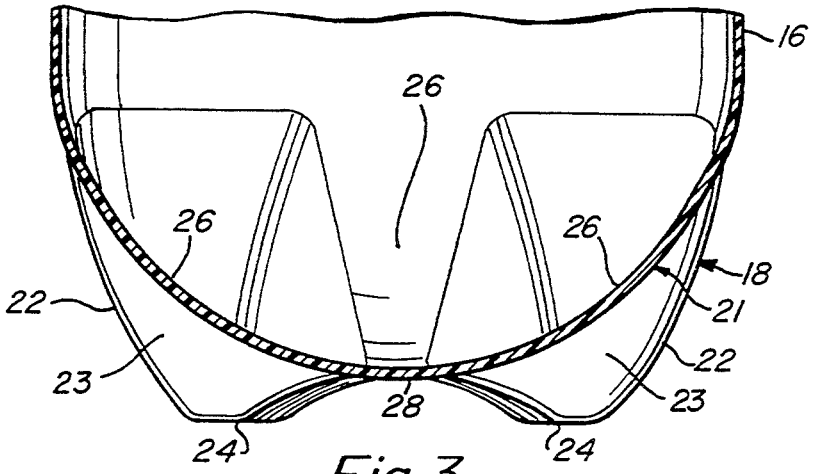
FIG. 3 is an enlarged fragmentary view taken along the section lines 3—3 of FIG. 2, showing a vertical cross section of the base through two opposing ribs.
Figure 4:
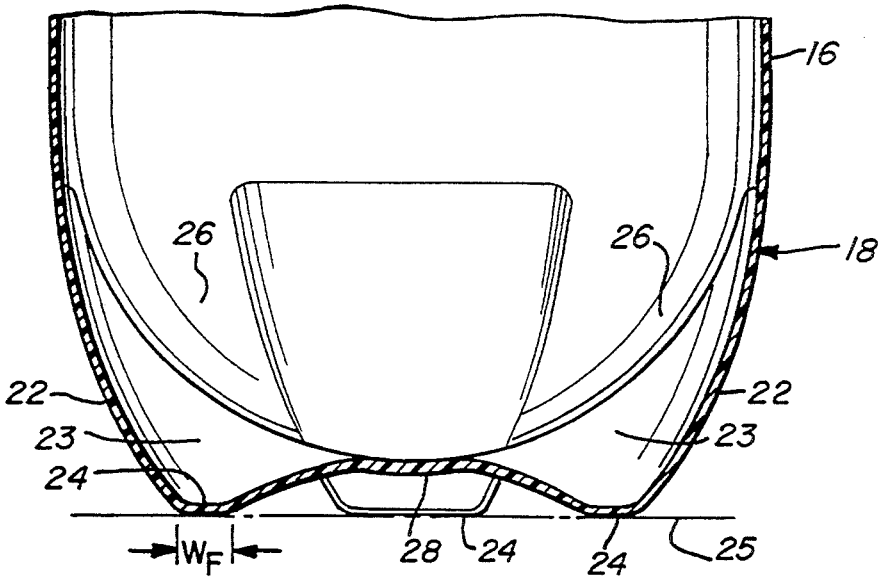
FIG. 4 is an enlarged fragmentary view taken along the section lines 4—4 of FIG. 2, showing a vertical cross section of the base through two opposing legs.

As shown in FIGS. 3–4, the base 18 blends smoothly into the cylindrical sidewall of panel 16. FIG. 3 is a vertical sectional view taken through an opposing pair of ribs 26 and shows that the ribs are generally or "substantially" hemispherical in vertical cross section (i.e., across the width of the container), with certain modifications as described hereinafter. FIG. 4 is a vertical sectional view taken through an opposing pair of legs 22 and shows that the legs extend downwardly of the ribs 26. A central dome or polar portion 28 of the base is defined by the junction of the ribs 26. At least a portion of the feet 24 lie in a common horizontal plane 25 on which the bottle rests upright.

There is some thickness variation across the various wall portions of the base according to the degree of material distension involved in blowing the preform to a final configuration in the mold (not shown). Generally, a stretch rod seats the bottom center of the preform in contact with a central dome portion of the mold, and then the legs are blown downwardly and outwardly. Thus, the ribs 26, which are part of the generally hemispherical bottom wall 21, are blown less than the legs and have a relatively greater thickness $t_R$ compared to the leg thickness $t_L$ (see FIG. 5*a*). The relative amounts of material available for blowing the ribs and legs respectively is important and is discussed in greater detail below in terms of this invention. Although not shown in the drawings, the dome 28 is generally substantially thicker than the sidewall 16 (e.g., 4× as thick), and the rib wall 26 is gradually reducing in thickness moving radially outwardly toward the sidewall. Also, the outer leg wall gradually decreases in thickness going from the sidewall 16 to the foot 24.

The container may be made from any plastic material, but preferably is made of polyester and more preferably a homopolymer or copolymer of polyethylene terephthalate (PET). PET copolymers having 3 to 5% comonomer are in widespread use in the beverage container industry and may be, for example, the resin 9921 sold by Eastman Chemical, Kingsport, Tenn., or the resin 8006 sold by Goodyear Chemical, Akron, Ohio. Other thermoplastic resins which may be used are acrylonitrile, polyvinyl chloride and polycarbonates.

1. Overall Requirements For The Base Design Of A One-Piece Pressurized Container The base configuration of this invention was designed for a free-standing, one-piece, blow-molded thermoplastic resin container for carbonated beverages. In this regard, the following functional requirements had to be met:

Internal pressure resistance
Drop impact resistance
Standing stability
Blow moldability
Light in weight.

The first requirement, internal pressure resistance, concerns the ability of the bottle to withstand fill pressures on the order of 40 p.s.i., and internal pressures of up to 100 p.s.i. or more in storage, when exposed to the sun, in warm rooms, car trunks, and the like. Generally, the weakest part of the bottle is the bottom end. The material of the base, and in particular the less-oriented rib sections, may creep under pressure and tend to bulge outwardly. This creep increases the volume of the bottle and thus lowers the fill line, leading the customer to believe the bottle was underfilled, which is undesirable. Also, stress cracks may develop in the less-oriented ribs where the major portion of the load is carried. While increasing the cross-sectional area (width and thickness) of the ribs decreases the creep and stress cracking, it also increases the cost of the bottle (by requiring more material) and may decrease the blow-moldability of the legs because less material is available for forming the leg. These competing considerations must all be taken into account.

The second criterion, drop impact resistance, relates to the ability of the bottle to be dropped without fracturing or leaking. In this regard, increasing the cross-sectional area (width and thickness) of the foot is helpful, but may adversely increase the cost and/or decrease the amount of rib area. It is also important to provide the leg shape with smooth blend and corner radii in order to avoid producing areas of stress concentration.

The third criterion, standing stability, relates to line handling (i.e., not falling off the conveyor line during manufacture or filling) and shelf stability in the store or customer's refrigerator. There is a minimum distance required between the foot and dome (dome height) so the bottle will not rock. Generally, setting the foot further out towards the circumference and increasing the foot area will make the base more stable, but may also make it harder to blow the leg and foot and/or decrease the area available for the ribs.

The fourth criterion, blow moldability, relates to the ease of forming the bottle (in the preferred reheat stretch blow molding process), and to minimizing the number of rejects (i.e., improperly formed legs). A shallower leg is generally easier to blow but may not have the standing stability or orientation (strength) required to form a deformation-resistant base. Also, providing more leg area for ease in blowing reduces the available rib area for strength.

The fifth criterion, light in weight, relates principally to making the bottle less expensive. A heavy base may be stronger and more stable, but costs more (in material) to produce. Cost is very often the determinative factor in the beverage bottle industry, assuming the functional requirements can be met.

All the above requirements are taken into consideration in the design of the base structure of this invention. The invention consists primarily in the design of the basic or bottom end shape and the specification of the size, the shape and the number of legs and ribs.

Figure 6:
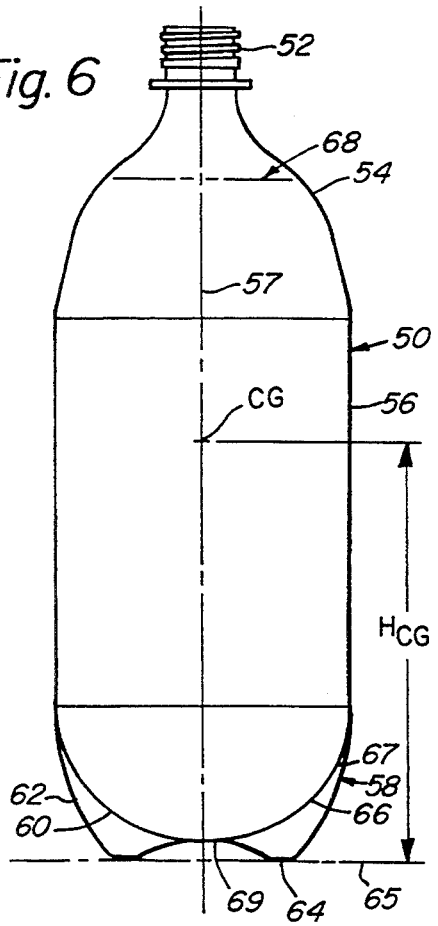
FIG. 6 is a front elevational view of a footed beverage bottle immediately after filling.
Figure 7:
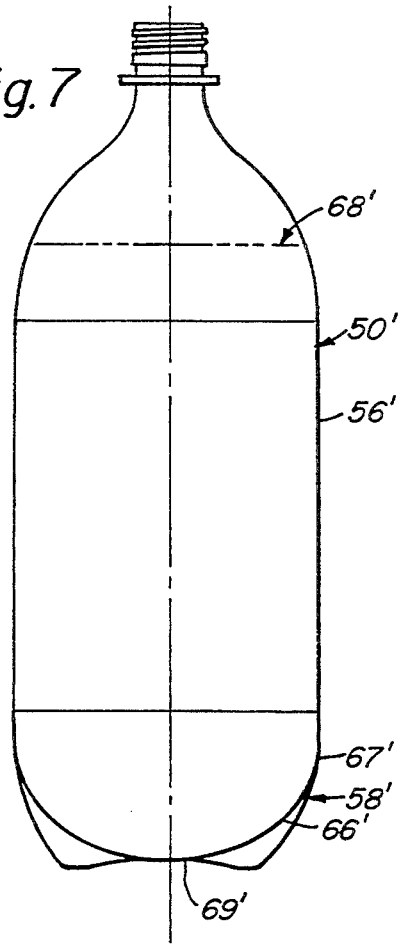
FIG. 7 is a front elevational view of the bottle of FIG. 6 which has undergone creep after filling, resulting in volume expansion and a drop in the fill line.
Figure 8:
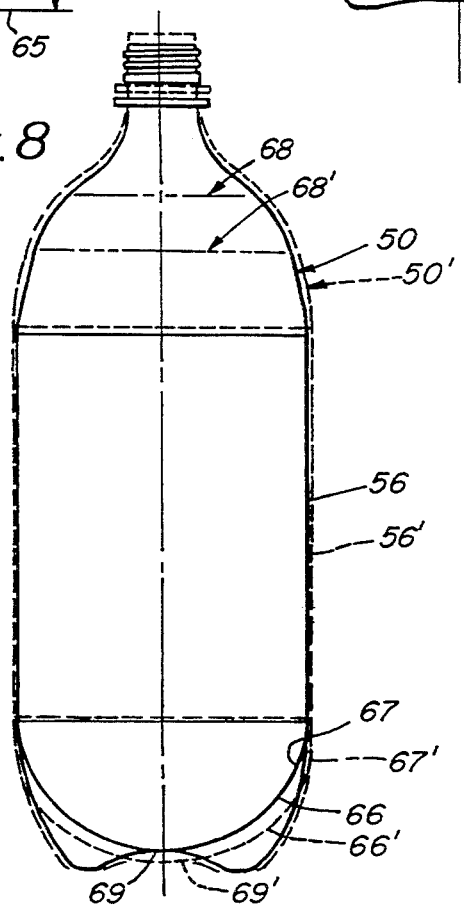
FIG. 8 is a front elevational view of the bottle of FIG. 6 in solid lines and the bottle of FIG. 7 superimposed in dashed lines, showing the relative dimensional changes due to creep.

FIGS. 6–8 illustrate the problem of creep generally in a looted beverage bottle. The bottle 50 has an upper thread finish 52, shoulder portion 54, cylindrical panel portion 56, and an integral base 58. The base 58 has a hemispherical bottom wall 60, with a plurality of downwardly-extending legs 62 that terminate in feet 64 and which are disposed between adjacent ribs 66 (defined by bottom wall 60). The bottle has a vertical cylindrical axis 57, along which lies the center of gravity (point CG) of the filled bottle at a distance $H_{CG}$ above the horizontal plane 65 on which the feet 64 rest.

FIG. 6 shows the bottle 50 immediately after filling, with dashed fill line 68 designating the height of the pressurized product (carbonated beverage) in the bottle. Sometime after filling, the internal pressure has caused the bottle to creep (FIG. 7). The dimensional changes produce an enlarged bottle 50' and cause a drop in the fill line 68' as shown in FIG. 7.

For ease of comparison, the as-filled bottle 50 of FIG. 6 and the enlarged bottle 50' (after creep) of FIG. 7 have been superimposed in FIG. 8 to illustrate where and to what extent the various bottle dimensions have changed. The original bottle 50 is shown in solid lines and the enlarged bottle 50' in dashed lines. A large amount of the dimensional change occurs in the base 58/58', and particularly in the rib area 66/66'. The ribs 66 bow outwardly, and in particular the upper rib 67/67' which becomes substantially coextensive (equal in diameter) with the cylindrical sidewall 56/56'. The dome 69/69', where the ribs meet at the center of the bottom wall, bows outwardly and may totally eliminate the base clearance (i.e., the vertical distance from foot to dome), thereby causing the bottle to rock.

Figures 9A, 9B, 9C:
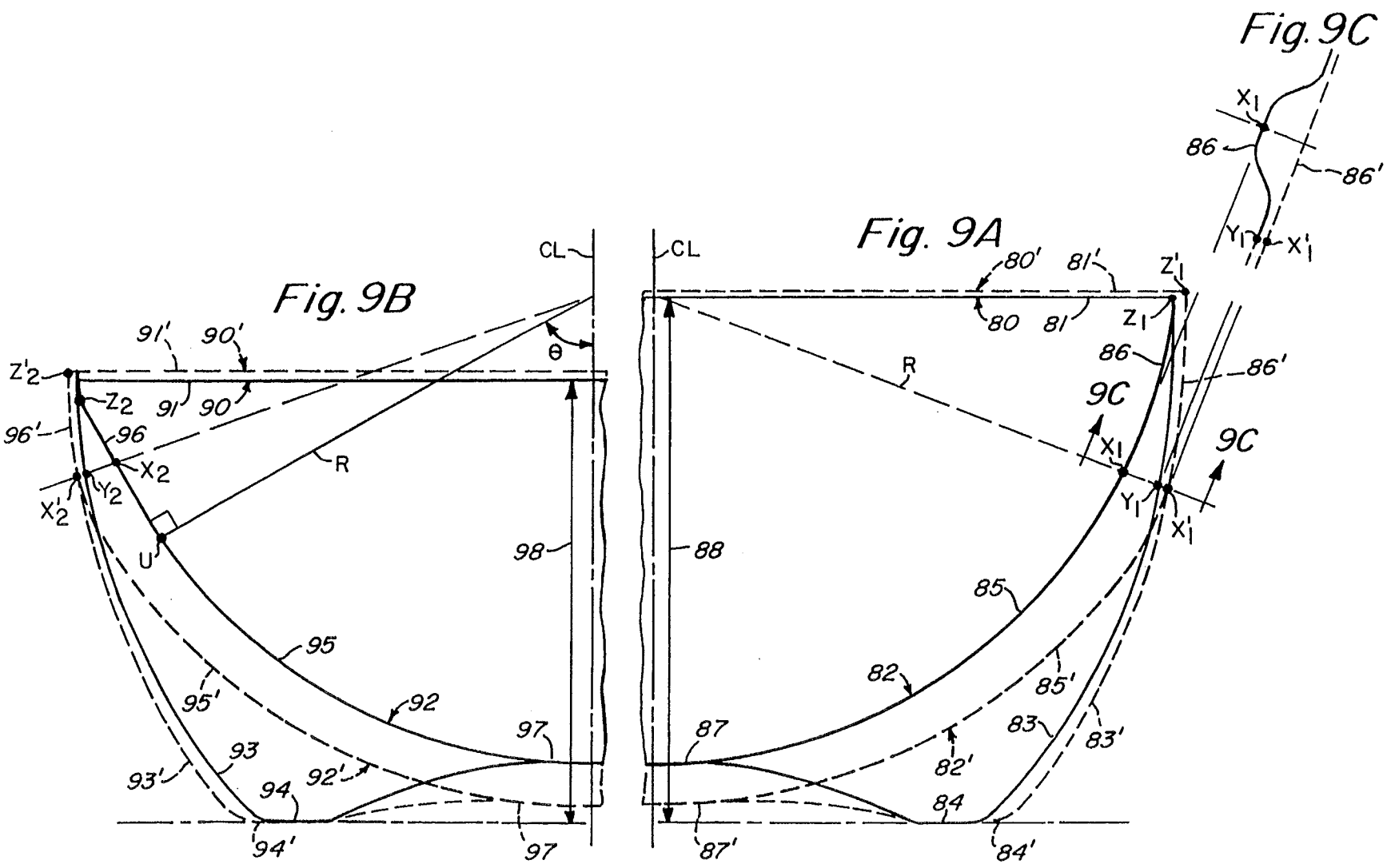
FIGS. 9(*a–c*) is an enlarged fragmentary view comparing a pure hemispherical base half on the right (FIG. 9A) with a modified hemispherical base half on the left (FIG. 9B)
Figure 10:
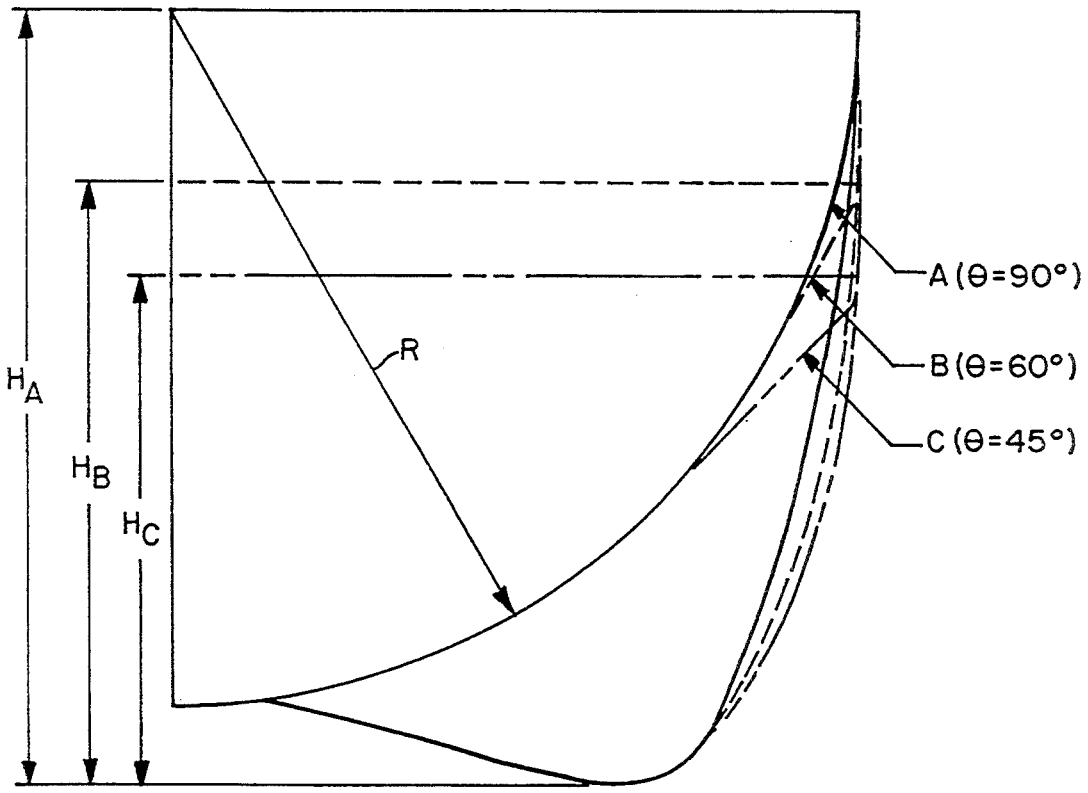
FIG. 10 is an enlarged fragmentary view showing two modified hemispherical base halves ($\theta=45°$ and 60°) superimposed in dashed and broken lines over a pure hemispherical base half ($\theta=90°$) in solid lines.
Figure 11A:
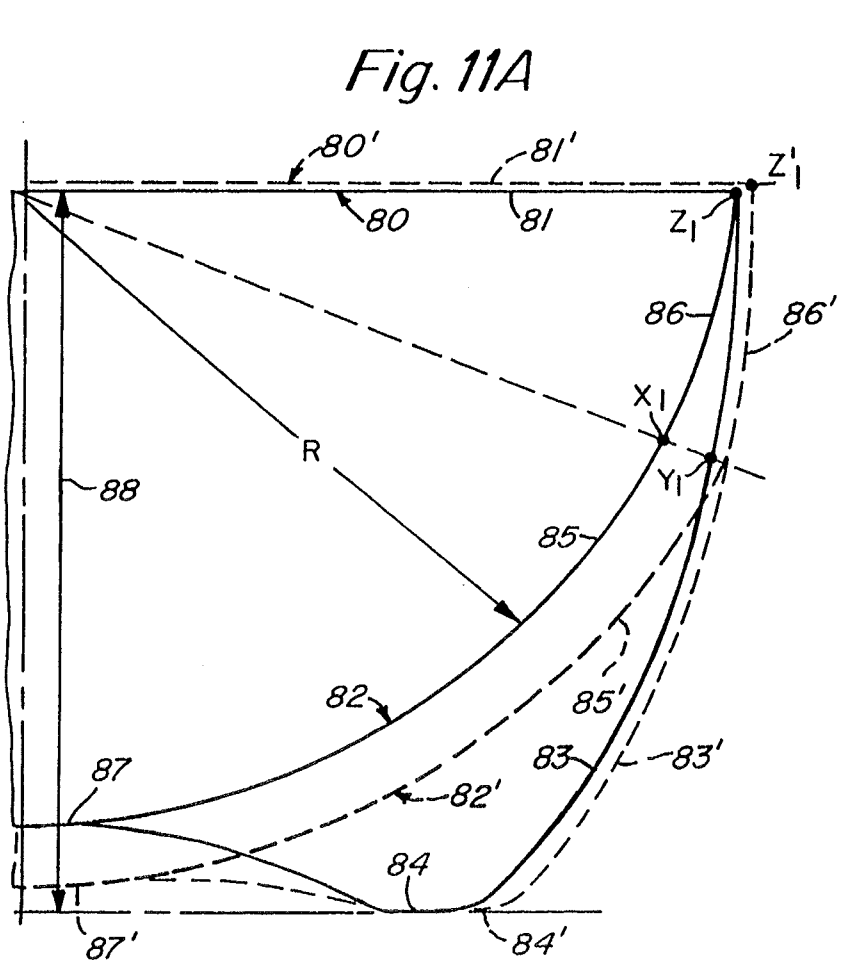
FIGS. 11(*a–b*) is an enlarged fragmentary view comparing a pure hemispherical base half on the right (FIG. 11A) with another type of modified hemispherical base half (i.e., truncated) on the left (FIG. 11B)
Figure 11B:
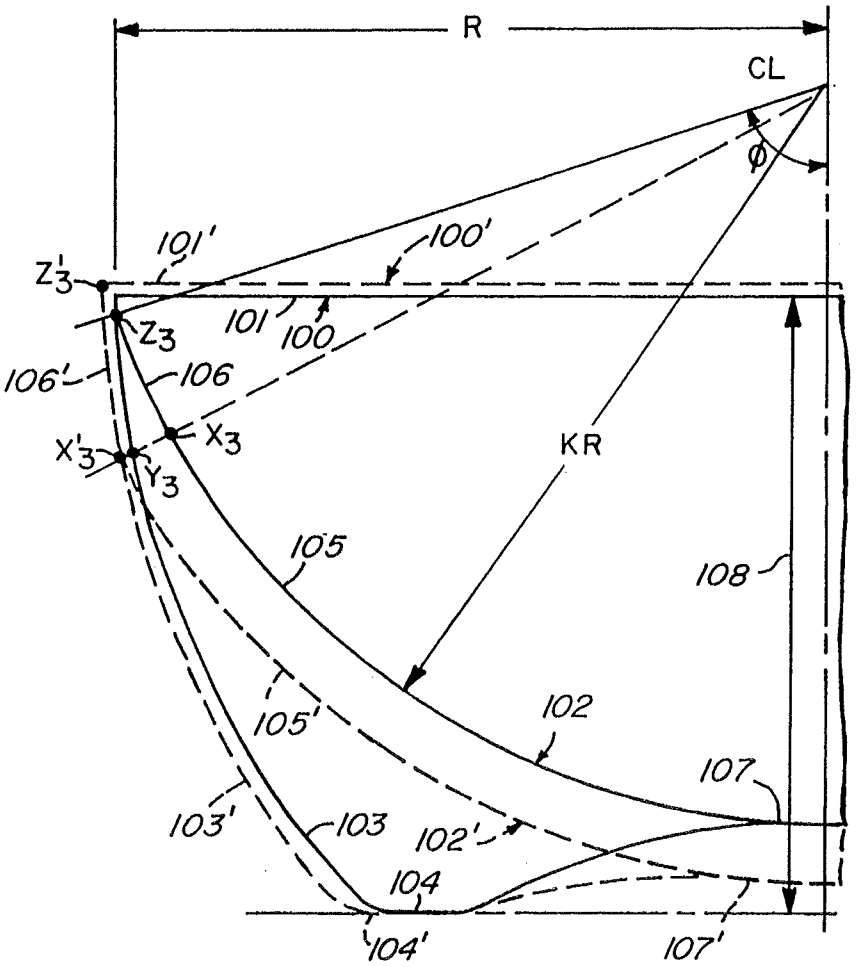
Figure 12:
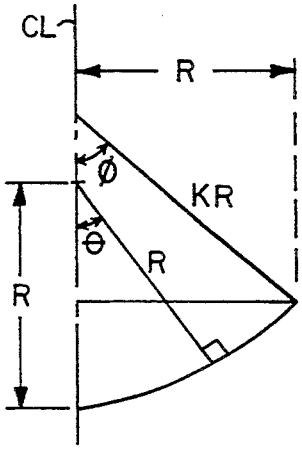
FIG. 12 relates to the truncated base half of FIG. 11 and includes on the right, a schematic illustration of a truncated base half portion, showing the geometrical relationship between the modified hemispherical radius KR and the angles $\theta$ and $\phi$, and on the left, a table of exemplary values for K, $\theta$ and $\phi$.

In order to reduce the dimensional changes in the base due to creep, the basic or bottom end shape of the base of this invention is preferably a modified hemisphere, as shown in FIGS. 9–10, or a truncated hemisphere, as shown in FIGS. 11–12. The bottom end shape (and resulting rib configuration) remains "substantially hemispherical" with either of these two modifications.

FIG. 9 shows a pure (full) hemispherical four-foot bottle half on the right (FIG. 9A) of vertical centerline CL, and a modified hemispherical four-foot bottle half on the left (FIG. 9B). In FIG. 9A, the as-filled base 80 has a pure hemispherical base of radius R, the same as the radius of the upper cylindrical body portion (16 in FIG. 1). After creep, an expanded base 80' (dashed lines) results. There is expansion at both the top edge 81/81' and in the bottom wall 82/82' of the base, wherein the bottom wall includes leg 83/83', foot 84/84', rib 85/85', upper rib 86/86' and dome 87/87'. In particular, the upper rib after expansion 86' becomes coextensive with the leg and upper cylindrical body portion (16 in FIG. 1), and is thus effectively eliminated. This is illustrated in cross section in FIG. 9C. The original upper rib triangle $X_1$-$Y_1$-$Z_1$ becomes (after creep) arc $X_1'$-$Z_1'$, such that the initial rib depth $X_1$-$Y_1$ at section lines 9C is eliminated and the rib and leg become coextensive at $X_1'$. This expansion at the upper rib is undesirable because it produces a substantial part of the drop in fill line, and constitutes a weak point in the base.

As shown in FIG. 9B, the expansion in the upper rib is substantially reduced by incorporating a straight line portion 96 (in vertical cross section) in the upper rib. The base 90/90' (before/after expansion) includes a top edge 91/91', bottom wall 92/92', leg 93/93', foot 94/94', rib 95/95', upper rib 96/96' and dome 97/97'. The straight line portion 96 in the upper rib is between points U and $Z_2$, with a small blend radius arc above $Z_2$ for a smooth transition to the upper cylindrical sidewall. This reduces the base height 98 significantly, compared to base height 88 on the right. The original upper rib triangle $X_2$-$Y_2$-$Z_2$ becomes (after expansion) arc $X'_2$-$Z'_2$ (where the rib and leg are coextensive), resulting in a substantially smaller increase in base volume, as compared to the increase in FIG. 9A.

For a bottle diameter of below three inches, it is preferred to begin the straight-line portion 96 at an angle $\theta=35$ to 70° from the vertical centerline CL. For a bottle diameter of three inches or above, preferably $\theta=50$ to 70°. In FIG. 10, two examples of the modified base are shown superimposed with a pure hemispherical base: in solid lines, a base half A with a pure-hemisphere ($\theta=90°$) and a base height $H_A$; in dashed lines, a base half B with a modified hemisphere where $\theta=60°$ and a base height $H_B$; and in broken lines, a base half C with a modified hemisphere where $\theta=45°$ and base height $H_C$, where $H_A>H_B>H_C$. Generally, as $\theta$ decreases the stress increases in the base because it deviates more from a pure hemisphere (the strongest base design without legs). Thus, for a container holding a more highly pressurized beverage, it is desirable to use a higher $\theta$, e.g., $\theta=70°$ or greater. For lower pressure, one can use a lower $\theta$. In summary, while reducing $\theta$ reduces the creep, it may also increase the stress and thus a trade-off is made between reducing the stress cracking and reducing the volume expansion.

FIGS. 11–12 illustrate a second modified base design for reducing creep. Again, a pure-hemispherical base half 80/80' (before/after creep) is shown on the right of vertical centerline CL (FIG. 11A—same as FIG. 9A), and a truncated hemispherical base half 100/100' on the left (FIG. 11B). The right base half 80 has a diameter R (same as the cylindrical panel portion), whereas the left base half 100 has a diameter K×R, where K>1, and the base is cut-off (truncated) at less than a full hemisphere. Thus, the base height 108 on the left side is less than the base height 88 on the right side. The left base 100/100' (before/after expansion) includes a top edge 101/101', bottom wall 102/102', leg 103/103', foot 104/104', rib 105/105', upper rib 106/106' and dome 107/107'. The upper rib 106 includes a small blend radius arc above $Z_3$ for a smooth transition to the upper cylindrical sidewall (of radius R). The original upper rib triangle $X_3$-$Y_3$-$Z_3$ becomes (after expansion) arc $X'_3$-$Z'_3$ (where the rib and leg are coextensive). This produces substantially less volume expansion than the larger rib triangle of $X_1$-$Y_1$-$Z_1$ on the right.

FIG. 12 illustrates the relationship between the angle $\phi$, defined as the angular extent of the truncated hemisphere from the vertical centerline CL. The geometrical relationship is illustrated on the right where a half truncated hemisphere is shown in vertical cross section, the relationship between $\theta$, K and $\phi$ being:

$$K=\frac{1}{2}\left[(1+\tan\Theta-\sec\Theta)+\frac{1}{(1+\tan\Theta-\sec\Theta)}\right]$$

$$\phi=\sin^{-1}\left(\frac{1}{K}\right)$$

A table of exemplary $\theta$, K and $\phi$ values is set forth on the left in FIG. 12. The preferred values of K are, for a small bottle of less than three inches in diameter, K=1.283 to 1.019 and $\phi$ is about 50°–80°, and for a larger bottle of diameter three inches or above, K=1.105 to 1.019 and $\phi$ is about 65°–80°.

Other bottom wall shapes may be useful in this invention, such as an elliptical shape having a radius R' greater than the radius R of the upper panel portion 16 of the container and where R' is measured from a point off the vertical centerline of the container. In this specification and claims, the term "substantially hemispherical" is meant to include a pure hemisphere, a modified hemisphere of FIGS. 9 or 11, and an elliptical shape as well. The preferred shape is one which reduces the base height and in particular the modified hemispheres of FIGS. 9 and 11.

Of particular importance, the substantially hemispherical bottom wall (including the ribs 26, dome 28 and rib/leg transitions 27) is a continuous substantially smooth surface with no abrupt steps or sharp discontinuities, such as a reentrant portion, which would generate stress concentrations and thus reduce the resistance to stress cracking. Thus, all of the junctions between the pure hemi and straight line portions (FIG. 9) are smooth, as well as the junctions of the ribs and legs.

3. Design Of The Ribs And Legs

The structural strength, the weight of the base, the standing stability and the formability requirements govern the size, the shape and the number of legs and ribs in the design.

Figure 13:
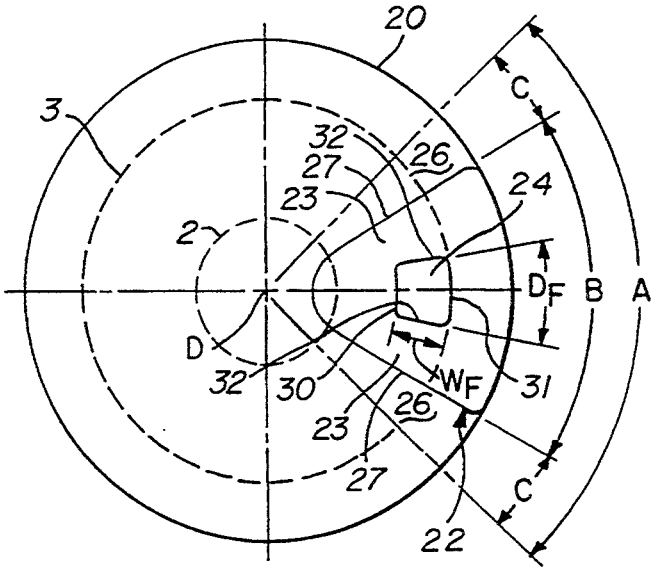
FIG. 13 is a bottom schematic view of a four-foot base according to this invention showing the circumferential angular extent of one leg (B) and the two adjacent half ribs (C)

FIG. 13 is a schematic bottom view showing one leg 22 and two adjacent half ribs 26 of a four-foot base of this invention (similar to FIG. 2). The base has a lowermost center dome point D and an outer circumference 20 where it joins the upper cylindrical sidewall 16. The angular extent B of each leg 22 is defined to include the small blend radius arc 27 between angled sidewall 23 of the leg and the rib 26, such that rib wall 26 forms a substantially straight line in horizontal cross section (see FIG. 5) between adjacent legs 22. The angular extent of each half rib is defined by C, such that B+2C=A, where A=90° (one quadrant) for a symmetrical four-foot base. The angular extent of the foot is defined by $D_F$ and the radial extent of the foot by $W_F$.

Figure 14:
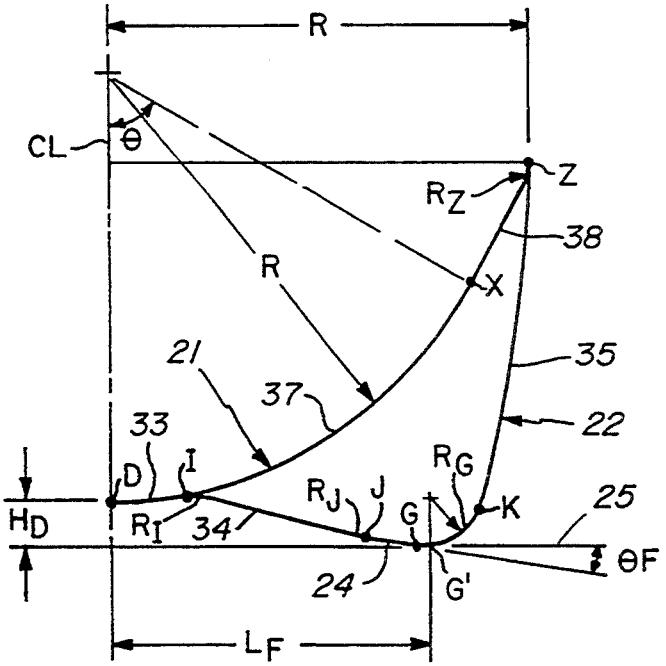
FIG. 14 is a vertical schematic view of a four-foot base according to this invention showing a vertical cross section of one leg.

In the embodiment shown in FIG. 13, the ribs are "pie-shaped" (i.e., purely angular) so that they have the same "angular extent" at each radial distance from the centerpoint D to the outer circumference 20 where they meet the cylindrical sidewall 16. However, in alternative embodiments the ribs may be other than "pie-shaped", such as having parallel sides for some or all of their radial length or having other width-varying portions transverse to the radial direction. The importance of the angular extent of the rib is chiefly with regard to creep resistance and stress crack resistance. For these purposes, the most important area of the rib is that between two concentric circles passing through I (FIG. 14, the point where the ribs and inner leg wall separate) and G' (FIG. 14, the outer edge of the foot). It is in this rib area where most stress cracks occur. Therefore, as used in this specification and claims the "average angular extent" of the rib means an average taken between two concentric circles (shown in dashed lines 2, 3 in FIG. 13) which lie between about 25% and about 65% of the distance from center point D to circumference 20. Again, for a substantially "pie-shaped" rib, the angular extent at each radial distance is the same the "average" radial extent.

3a. Structural Strength and Base Weight

In a base structure consisting of legs and ribs, the major portion of the load due to internal pressure is carried by the ribs. However, some portion is carried by the legs. The load carrying capacity of each leg can be expressed theoretically as $K_L$ equivalent degrees of rib, such that the total load carrying angular extent $\Psi_L$ is given by:

$$\Psi_L N(2C+K_L)=(T_R+NK_R)$$

where N=number of legs, 2C=the angular extent of each rib, and $T_R$=total angular extent of the ribs. In general, $K_L$ is in the range of 8° to 16° for any leg shape.

The strength of the base, i.e., resistance to creep under pressure, is proportional to the total load carrying angular extent $\Psi_L$ and the rib wall thickness $t_R$ (see FIG. 5). A full hemispherical base (no legs) could be viewed as having $T_R$ equal to 360°, for which the required rib wall thickness $t_{360}$ is given by:

$$t_{360} = \frac{PR}{2\sigma_{max}}$$

where P is the internal bottle pressure, R is the radius of the bottle, and $\sigma_{max}$ is the maximum allowable stress, a material property. In bases with legs, the required rib wall thickness $t_N$ is given by:

$$t_N = \frac{PR}{\sigma_{max}} \times \frac{180}{\Psi_L}$$

This shows that the rib wall thickness $t_N$ is inversely proportional to the total load carrying angular extent $\Psi_L$.

The weight W of the base can be estimated as follows:

$$W=A_s \times t_N \times d$$

where $A_s$ is the surface area of the bottom shape without the legs, $t_N$ is the rib wall thickness, and d is the density of the material. For a given bottom shape and material, the base weight W is thus inversely proportional to the total load carrying angular extent $\Psi_L$.

A stress analysis on a modified hemispherical base (FIG. 9B) would be expected to show the stress in the base increasing with lower $\theta$ values. Similarly, for a truncated hemisphere (FIG. 11), the stress in the base varies with K. In order to account for this, a shape factor SF is introduced into the rib thickness $t_N$ equation as follows:

$$t_N = \frac{PR}{\sigma_{max}} \times \frac{180}{\Psi_L} \times SF(\text{for modified hemi})$$

where SF is the shape factor determined by the shape of the bottom end. For a base with legs having a rib vertical cross section which is a full hemisphere, SF=1; SF>1 for other modified shapes. Thus, for a given bottom end shape, the rib thickness $t_N$ is still inversely proportional to the total load carrying angular extent $\Psi_L$.

Where lower cost is a determinative factor, the total angular load carrying extent $\Psi_L$ can be increased in order to increase the strength, while decreasing the rib thickness in order to produce a lighter weight bottle (less material equals less expensive product). The lowest allowable fill line would be maintained. If instead, it is desired to minimize the drop in the fill line (i.e., minimize creep), then the rib cross section (width and thickness) should be increased (requiring more material and thus being more expensive).

3b. Standing Stability and Formability

The shape and size of the leg and foot are important for standing stability and blow-moldability. FIGS. 13–14 show a bottom and cross-sectional view of one leg 22 of a four-foot modified hemispherical base of this invention. As shown therein:

$H_D$ is the foot-to-dome height;

$L_F$ is the distance from the center of the dome D to the outer edge of the foot, in this case to the point G' at which a vertical line from the center of radius $R_G$ intersects the foot (same as 31 in FIG. 13);

$D_F$ is the angular extent of the outer edge 31 of the foot, wherein in this case the trapezoidal-shaped foot 24 has equal side edges 32, 32 which divert outwardly from a short inner edge 30 to a longer outer edge 31;

$W_F$ is the width of the foot from the inner edge 30 to the outer edge 31 (i.e., the length of side edges 32); and $\theta_F$ is the angle which the foot makes with the horizontal plane 25.

As shown in cross section in FIG. 14, the leg 22 includes, starting from a blend radius arc $R_I$ where it joins the substantially hemispherical bottom wall 21, an inner straight line or arc leg portion 34 from I to J, ending in a blend radius arc $R_J$, a foot 24 of width $W_F$ from J to G', a large radius at arc $R_G$ at the outer edge of the foot from G to K, and an outer straight line or arc leg portion 35 from K to Z, which is tangential to a small blend radius at arc $R_Z$ for a smooth transition to the cylindrical sidewall 16. The rib 26 includes in vertical cross-section, starting from the center D of the dome 33, a pure hemispherical portion 37 from D to X, defined by angle 8 from centerline CL and radius R, and a modified hemispherical (straight line) portion 38 from X to Z where it terminates in a small blend radius at arc $R_Z$ for a smooth transition into the sidewall 16.

With the four-foot base of this invention, there is more base material available to form the foot which enables the area of the foot to be increased and/or the foot to be moved radially outward, in order to increase the standing stability while preserving the ease of blow-moldability (or vise versa, to increase the ease of blow-moldability while holding the foot area and position constant). Thus, the width $W_F$ and/or angular extent $D_F$ of the foot may be increased, and/or the entire foot, or at least the outer edge 31, may be moved outwardly toward the outer bottle circumference 20 (i.e., increase $L_F$).

Still further, the inner leg wall 34 between the foot 24 and a central portion of the bottom wall 33 is preferably a continuous and substantially smooth surface which is at an acute angle to the common plane 25 on which the feet reside. The acute angle is preferably of from about 10° to about 60° and more preferably from about 15° to about 30°.

3c. Tip Length

In general, reducing the number of feet will reduce the tip length and thus reduce the standing stability of the bottle. However, in this invention the foot shape and location can be adjusted such that there is no reduction in tip length.

Figure 15:
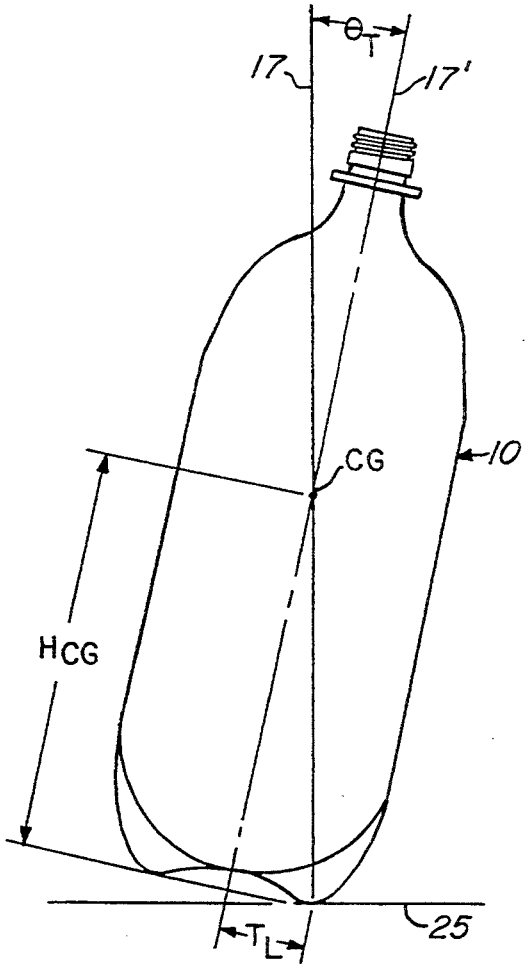
FIG. 15 is a vertical schematic view of a bottle showing the relationship between the tip length $T_L$ and the center of gravity CG.

FIG. 15 shows bottle 10 having a center of gravity CG on vertical centerline 17 at height $H_{CG}$ above the horizontal plane 25 on which the bottle normally rests. The bottle 10 is tipped at the maximum theoretical angle at which it can balance and not fall down (i.e., the tip angle $\theta_T$). The tip angle $\theta_T$ is defined as the angle between vertical centerline 17 when the bottle is upright and the vertical centerline 17' of the bottle when tipped at the maximum angle without falling. Thus, the larger the tip angle the more stable the bottle.

Figure 18:
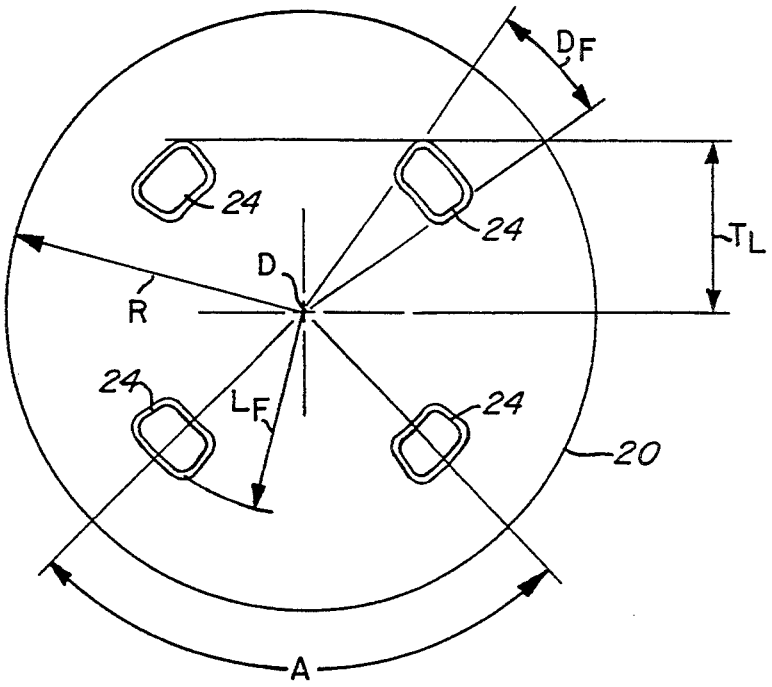
FIG. 18 is a bottom schematic view of a four-foot base according to this invention, showing the tip length.

The shortest tipping distance is between two feet (rather than tipping over one foot) so that the tip length $T_L$ is defined as the distance from the center of the dome D to a tangent which connects the outermost edges (while tipped as shown in FIG. 15) of two adjacent feet 24 (see FIG. 18). The tip length $T_L$ is a function of the tip angle $\theta_T$ and the height $H_{CG}$ (center of gravity) and is defined by:

$$T_L=(\tan\theta_T)H_{CG}$$

Figure 16:
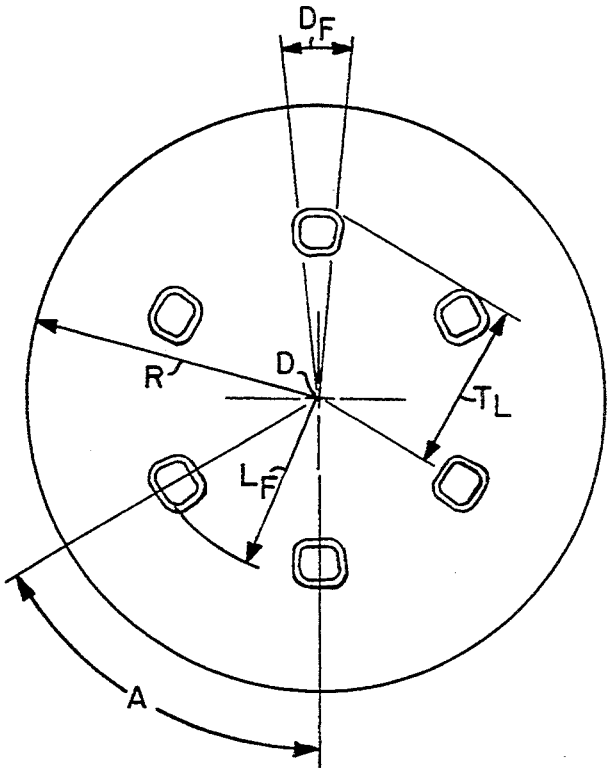
FIG. 16 is a bottom schematic view of a comparative six-foot base, showing the tip length.
Figure 17:
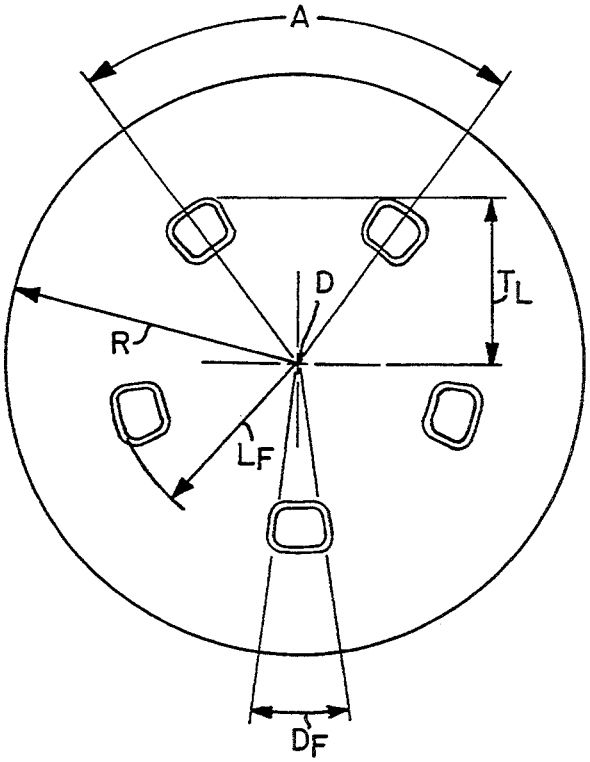
FIG. 17 is a bottom schematic view of a comparative five-foot base, showing the tip length.

For comparison purposes, the tip lengths of a six-foot, five-foot, and a four-foot bottle are shown in FIGS. 16–18, respectively, based on a representative 2-liter bottle having a height of 11.875 in., a diameter of 4.3 in., and a center of gravity $H_{CG}$ of 5.64 in. In FIGS. 16–18, A is the angular extent of one leg and two adjacent half rib areas (i.e., $A=360°/N$), $D_F$ is the angular extent of the foot, and $L_F$ is the distance from the center of the dome D to the outer edge of the foot. The six-foot base (FIG. 16) has a tip length $T_L=1.250$ in., while the five-foot base (FIG. 17) has a reduced tip length $T_L=1.245$ in. as a result of decreasing the number of legs, even though the foot has been moved radially outward ($L_F=1.392$ in. for the five-foot base as compared to $L_F=1.360$ in. for the six-foot base) and the angular extent of the foot has been increased ($D_F=17.0°$ for five-foot base as compared to $D_F=11.34°$ for the six-foot base). However, with the four-foot base of this invention (FIG. 18), a tip length equal to that of the five-foot base, i.e., $T_L=1.245$ in., can be preserved by moving the foot radially outward (closer to the circumference 20) to a significant extent ($L_F=1.502$ in. for the four-foot base, compared to $L_F=1.392$ in. for the five-foot base) and by increasing the foot angular extent ($D_F=20.46°$ as compared to $D_F=17.0°$). Thus, even though the number of legs is reduced, the tip length remains the same (i.e., the stability is maintained) by increasing $L_F$ and/or $D_F$.

3d. Stability and Formability

Figure 19:
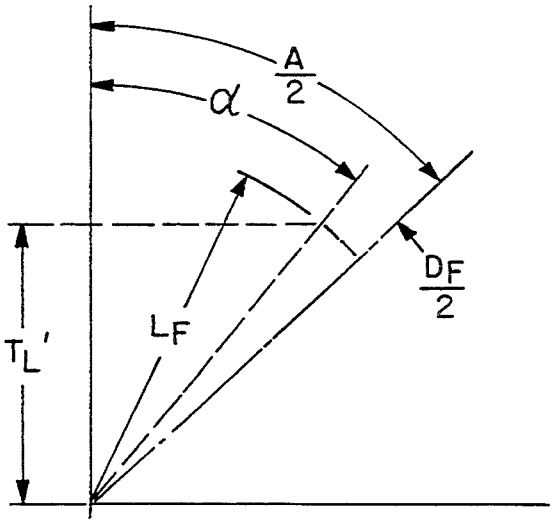
FIG. 19 is a schematic illustration showing the relationship between the tip length $T_L'$, the angular extent of the foot $D_F$, and the radial placement of the outer edge of the foot $L_F$.

With the four-foot base of this invention, there is more base material available to form the ribs while still preserving the blow-moldability of the legs. This enables a bottle designer to achieve an improved balance of properties regarding creep resistance, stress crack resistance, impact strength, weight, standing stability, and formability. In illustrating this balance of properties, the following relationships as defined in FIG. 19 are relevant:

$$A=\frac{360}{N}$$

$$\alpha=\left(\frac{A}{2}-\frac{D_F}{2}\right)$$

$$L_F=T_L'\sec\alpha$$

Note that $T_L'$ is determined by $L_F$ and thus is at the outer edge 31 of the foot when the bottle is upright, whereas $T_L$ is the outer edge when the bottle is tipped; $T_L'$ is approximately equal to $T_L$.

As previously discussed, the tip length $T_L$ is a measure of the standing stability. It is seen that as the number of legs N is decreased, $L_F$ must be increased to maintain the same $T_L$ (refer to FIGS. 15–18). The minimum angular extent of the leg required for the formability, $B_{min}$, is a function of $L_F$ and increases with $L_F$. As an approximation, if $D_F\approx 90/N$ and $B_{min}$ is proportional to $(L_F)^2$, then $B_{min}$ is proportional to $\sec^2(135/N)$.

In order to graphically illustrate the superior combination of properties achievable with the four-foot container of this invention, three performance criteria are graphed in FIGS. 20–25. The ease of formality is represented by B, the angular extent of the leg. The larger B is, the more material there is available to form the leg and foot and the easier it is to form the bottle. Stability is represented by the tip length $T_L$, which is a function of $L_F$ and $D_F$; a larger $T_L$ means a more stable bottle. Strength is represented by either $T_R$, the total angular extent of the ribs (which bear most of the stress), or by $\Psi_L$, the total load carrying angular extent (which includes the stress carried by the legs). Three specific examples of a four-foot container are given, with rib angular extents (2C) of 21°, 23° and 24°.

Figure 20:
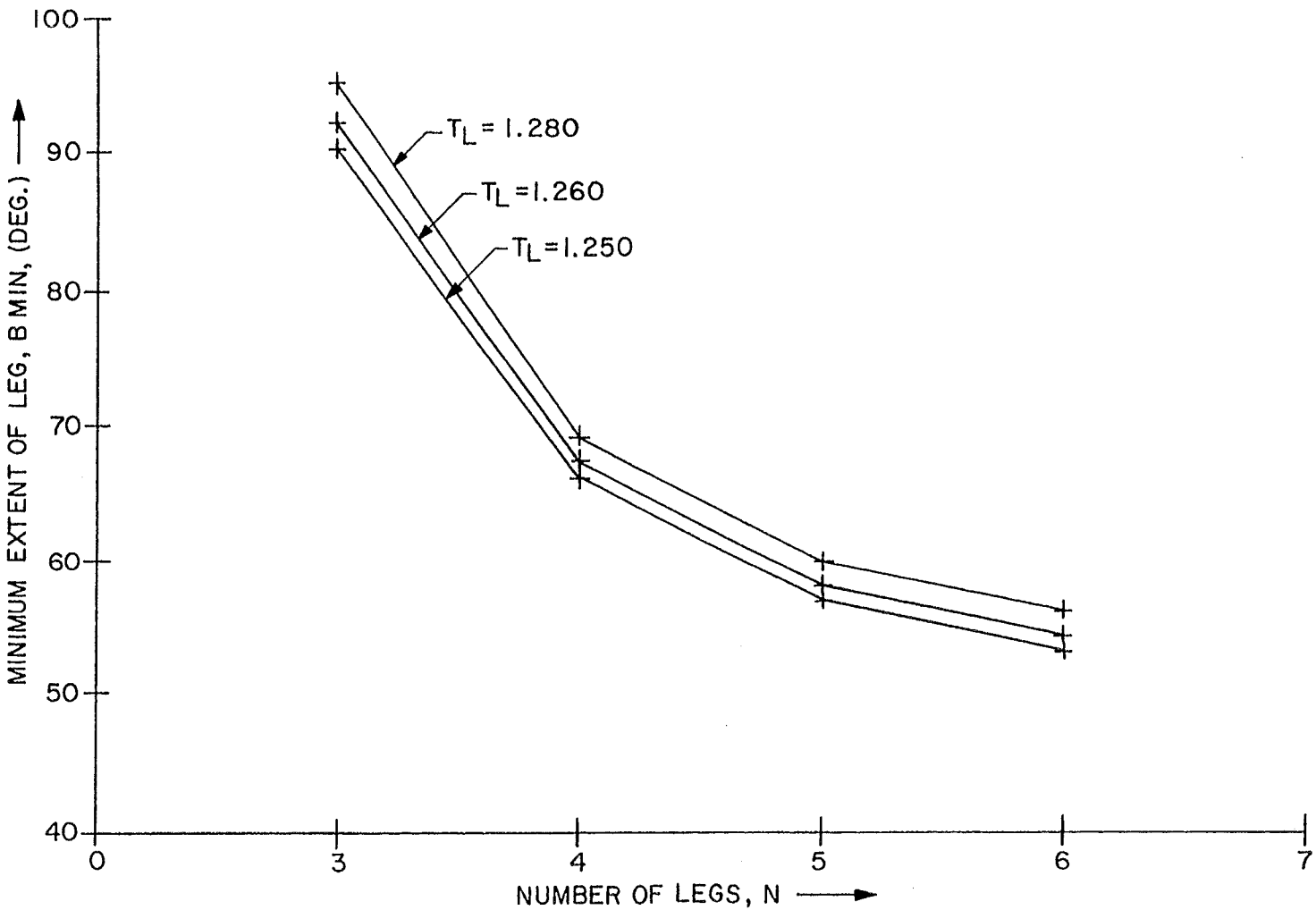
FIG. 20 is a plot of $B_{min}$ (the minimum angular extent of the leg) versus N (the number of legs) for various values of the tip length $T_L$.

The variation of $B_{min}$ with N for $T_L$ values of 1.250 in., 1.260 in. and 1.280 in. is given in Table A below and shown in FIG. 20. The same data is shown on the B vs. $T_R$ plot in FIG. 21, with constant stability $T_L$ curves. The relationship between $T_R$ and B is linear and is given by:

$$B=-(1/N)T_R+(360/N).$$

Figure 21:
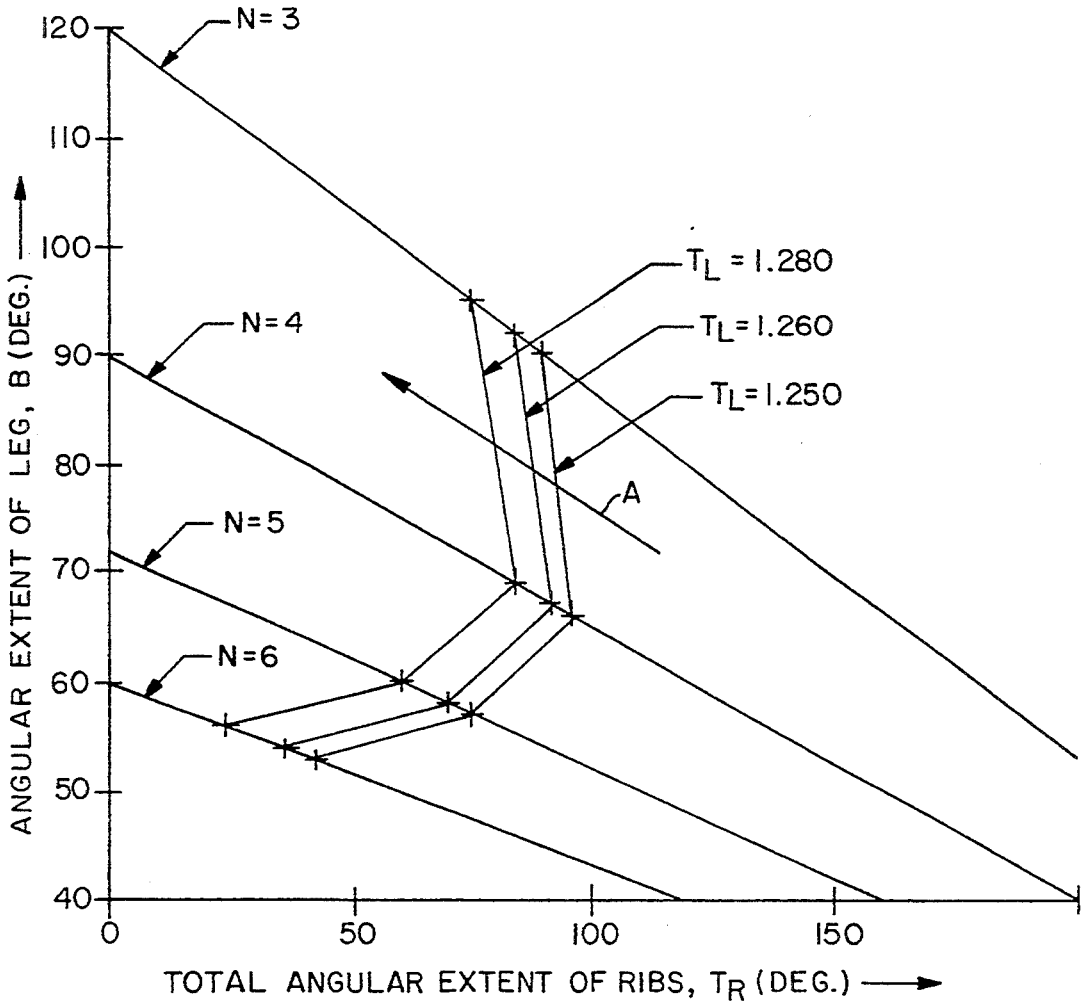
FIG. 21 is a plot of B (the angular extent of the leg) versus $T_R$ (the total angular extent of the ribs), with constant stability curves $T_L$ superimposed thereon.

It is seen that for higher stability $T_L$ (direction of arrow A in FIG. 21), higher $B_{min}$ is required resulting in lower $T_R$ (strength). Most important, FIG. 21 shows that for a constant stability $T_L$, maximum $T_R$ (strength) is achieved in every case when N=4, as opposed to N=3 5 or 6. Thus, FIG. 21 establishes that the four-foot container of this invention has a superior combination of formability and strength (at a constant level of stability) compared to the three, five and six foot containers. This superior combination of properties with a four foot container has not been realized by the prior art.

TABLE A

| | $B_{min}$ | | |
|---|---|---|---|
| N | $T_L$ = 1.250 | $T_L$ = 1.260 | $T_L$ = 1.280 |
| 6 | 53 | 54 | 56 |
| 5 | 57 | 58 | 60 |
| 4 | 66 | 67 | 69 |
| 3 | 90 | 92 | 95 |

Figure 22:
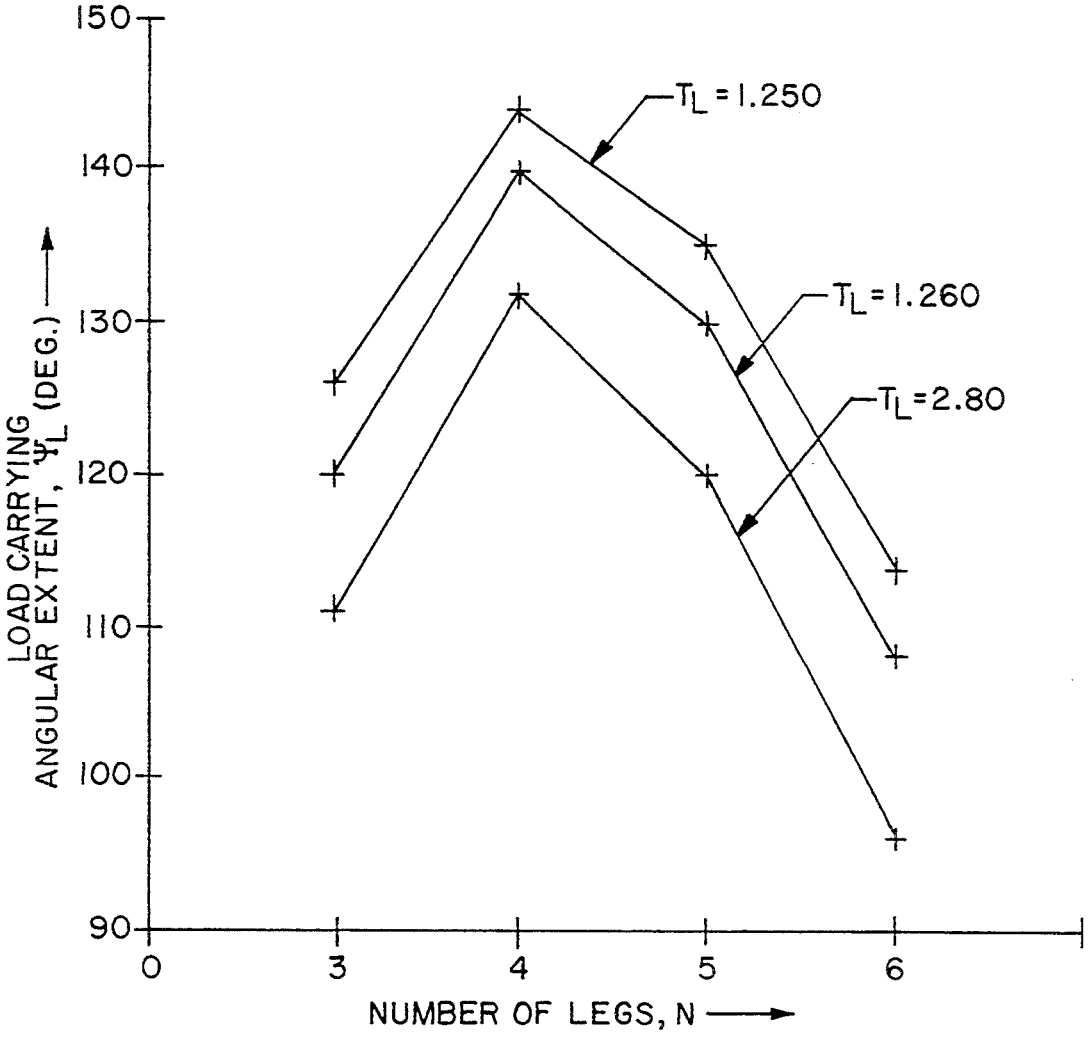
FIG. 22 is a plot of $\Psi_L$ (the total load carrying angular extent of the base) versus N (the number of legs) for various values of the tip length $T_L$.

As further evidence of the superior balance of properties achievable by a four-foot container according to this invention, the variation of the total load carrying angular extent $\Psi_L$ with N for $T_L$ values of 1.250 in., 1.260 in. and 1.280 in. and $K_L=12°$ is given in Table B and shown in FIG. 22.

TABLE B

| | $\Psi_L$ | | |
|---|---|---|---|
| N | $T_L$ = 1.250 | $T_L$ = 1.260 | $T_L$ = 1.280 |
| 6 | 114 | 108 | 96 |
| 5 | 135 | 130 | 120 |
| 4 | 144 | 140 | 132 |
| 3 | 126 | 120 | 111 |

It is seen that $\Psi_L$ (strength) is reduced with higher $T_L$ (stability) and that $\Psi_L$ (strength) for a given $T_L$ (stability) is maximized when N=4.

The Table C gives variations of $T_R$ (total angular extent of the ribs) with N for $\Psi_L$ values of 108, 120 and 130. This data is shown on the B vs. $T_R$ plot in FIG. 23, and yields the constant strength $\Psi_L$ curves. It is seen that for higher strength (direction of arrow A) the curve moves to the right, requiring higher $T_R$ values.

TABLE C

| N | $T_R$ $\Psi_L = 108$ | $\Psi_L = 120$ | $\Psi_L = 130$ |
|---|---|---|---|
| 6 | 36 | 48 | 58 |
| 5 | 48 | 60 | 70 |
| 4 | 60 | 72 | 82 |
| 3 | 72 | 84 | 94 |

Figure 23:
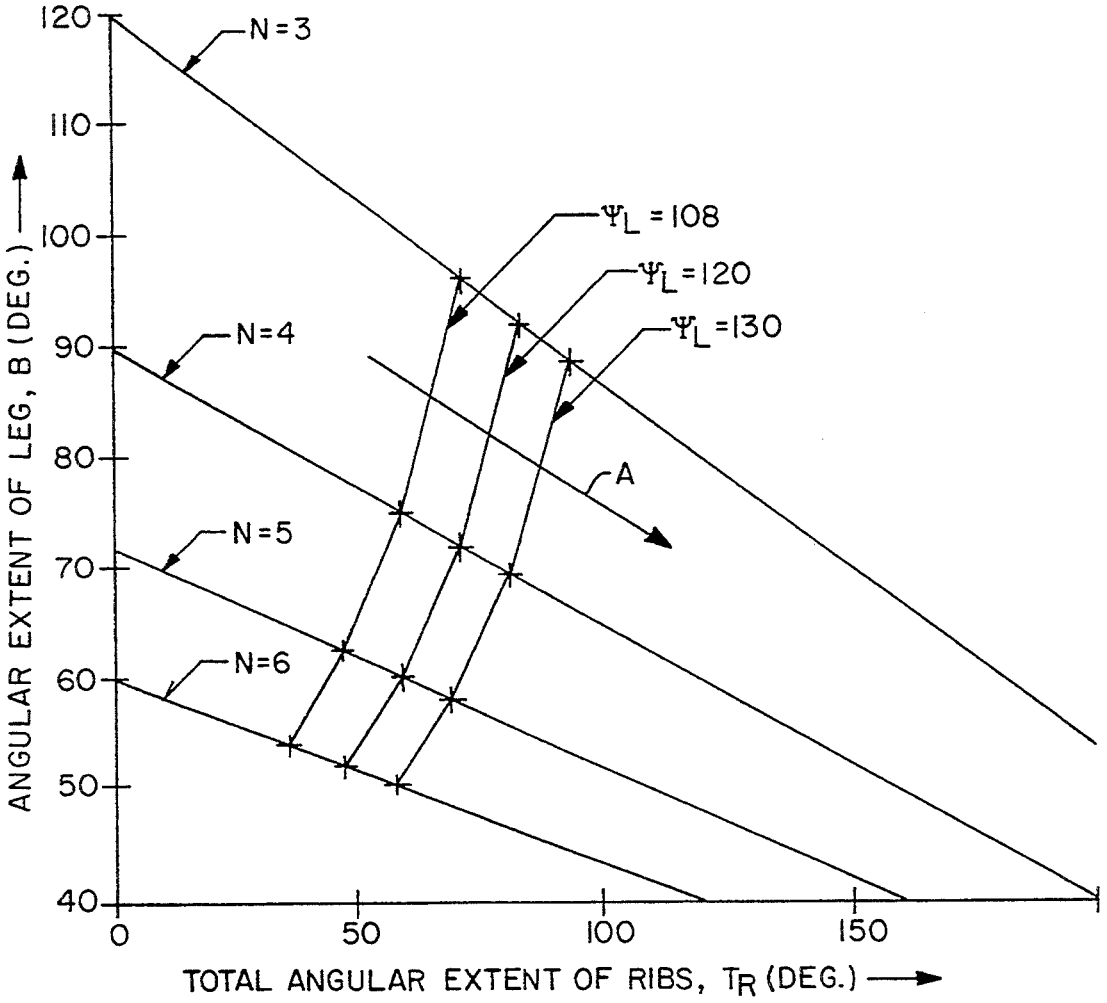
FIG. 23 is a plot of B (the angular extent of the leg) versus $T_R$ (the total angular extent of the ribs), with constant strength curves $\Psi_L$ superimposed thereon.
Figure 24:
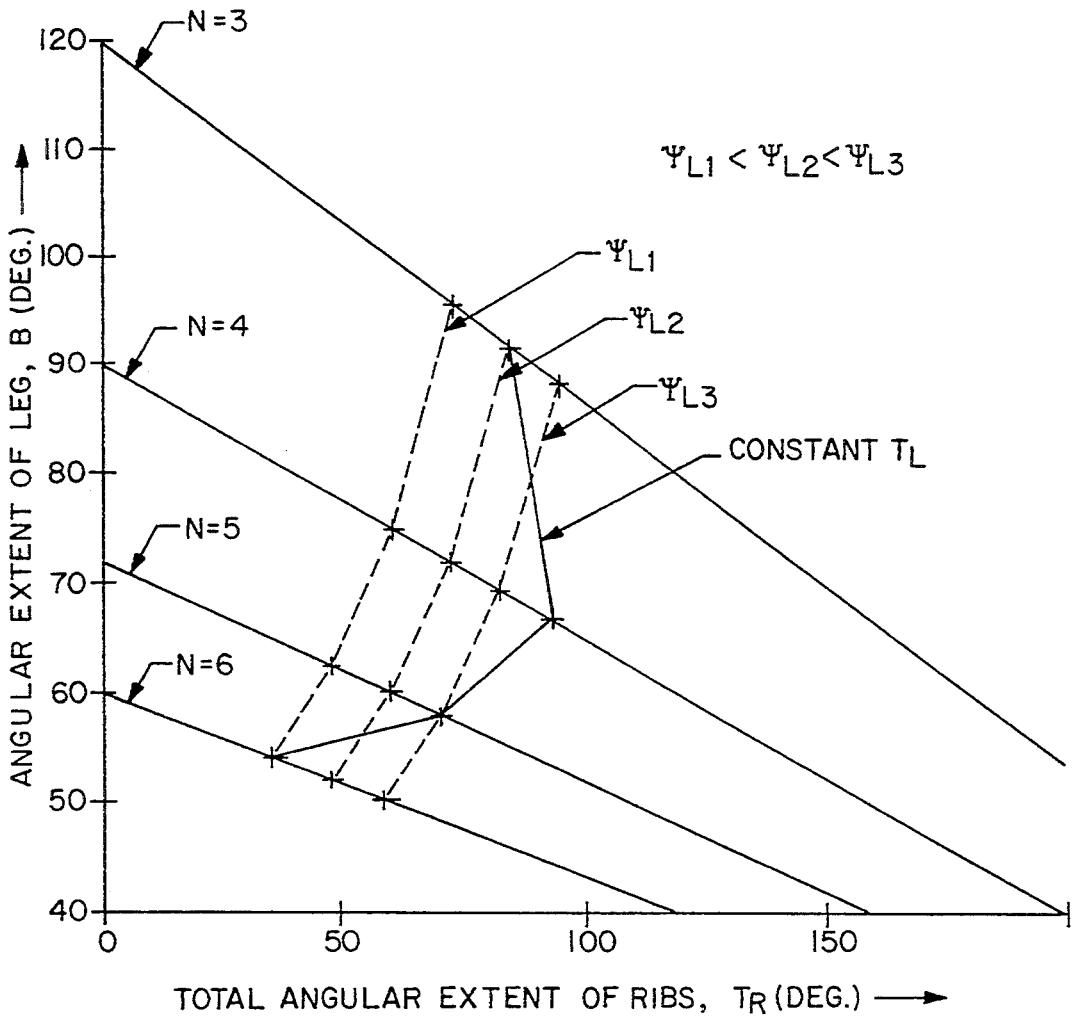
FIG. 24 is a plot of B (the angular extent of the leg) versus $T_R$ (the total angular extent of the ribs), with constant strength curves $\Psi_L$ and a constant stability curve $T_L$ superimposed thereon.

FIG. 24, which is similar to FIG. 23, shows three curves for increasing strength $\Psi_L$, but incorporates a constant stability curve $T_L$. It shows that for a given stability, as the strength requirement is increased the optimum case is when N=4.

Figure 25:
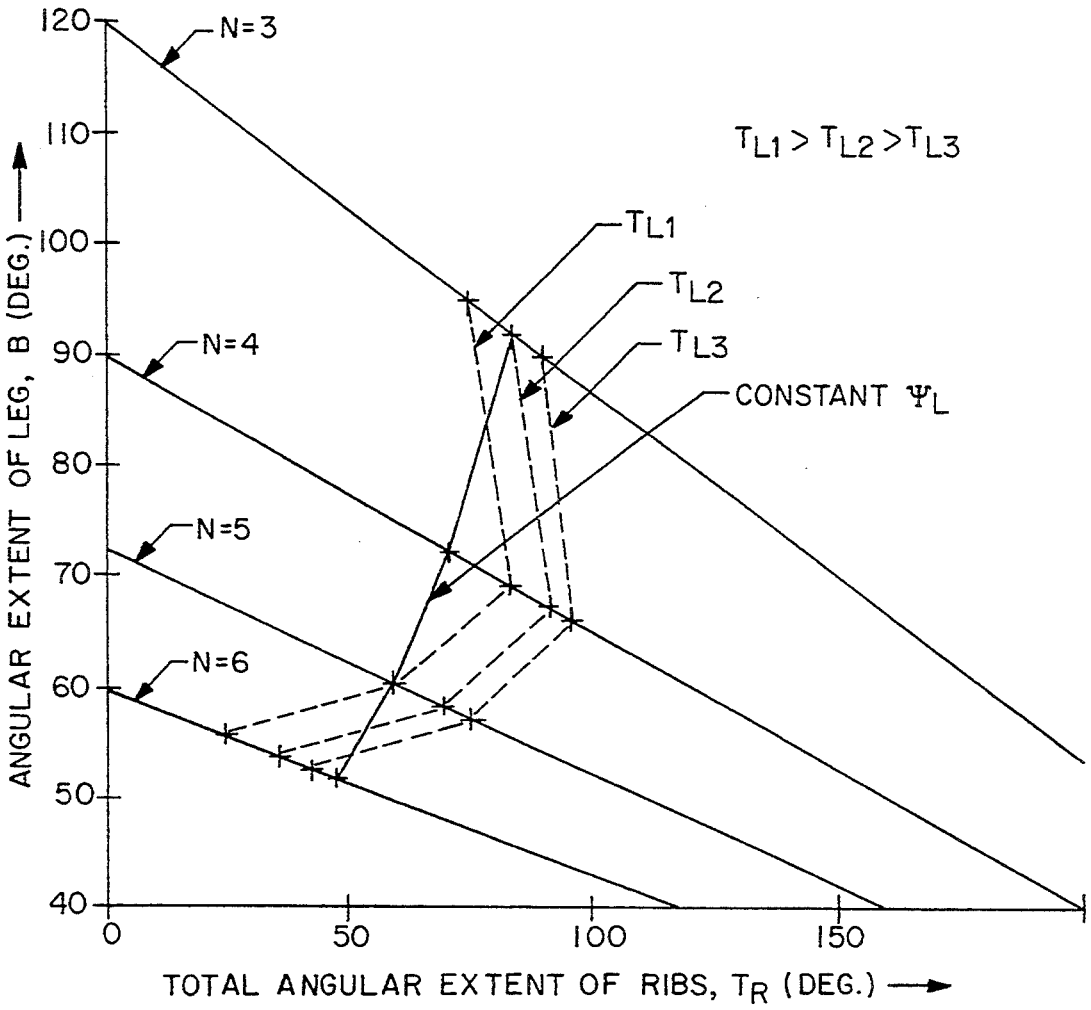
FIG. 25 is a plot of B (the angular extent of the leg) versus $T_R$ (the total angular extent of the ribs), with constant stability curves $T_L$ and a constant strength curve $\Psi_L$ superimposed thereon.

FIG. 25, which is similar to FIG. 21, shows three curves for increasing stability $T_L$, but incorporates a constant strength curve $\Psi_L$. It shows that for a given strength requirement, the stability is maximized in the case when N=4.

In addition to the three different four-foot base designs illustrated in FIGS. 20–25 and described in Tables A–C, the following are specific examples of the invention.

EXAMPLE 1

A 16-ounce, four-foot freestanding PET container was made according to the present invention. The container had a reduced base height, and incorporated the design features of both FIGS. 9B (upper straight line portion) and FIG. 11B (truncated hemi). The container dimensions are listed below under the column entitled "FOUR-FOOT".

The performance of this four-foot container was compared to a 16-ounce five-foot container having a similar reduced height base design with the dimensions listed below under the column entitled "Five-Foot". The containers were made from the same type of resin and processed similarly via an injection mold, reheat stretch blow mold process.

| | FOUR-FOOT | FIVE-FOOT |
|---|---|---|
| R | 1.430 in | 1.430 in |
| K | 1.084 | 1.084 |
| KR | 1.550 | 1.550 |
| $\Theta$ | 45° | 45° |
| $R_z$ | 0.250 in | 0.250 in |
| $H_D$ | 0.1 R | 0.1 R |
| $L_F$ | 0.75 R | 0.65 R |
| $\Theta_F$ | 7° | 7° |
| $D_F$ | 25° | 20° |
| 2C | 20° | 12° |
| B | 70° | 60° |

A number of performance tests were conducted to compare the four-foot and five-foot containers. The results are set forth below.

Firstly, as to base weight, the four-foot container was superior, requiring 0.4 grams less of PET.

Secondly, the four-foot container exhibited a burst pressure of 189 psi. Burst pressure was determined by filling with room temperature water and pressurizing until the container failed (leaked). In both cases the sidewall failed before the base.

Thirdly, the containers were tested for drop impact by filling 20 samples of each container with 16-ounces of carbonated water (4 atm), capping, and dropping each container a distance of four feet onto a hard steel surface (with the base striking the surface first). Both the four-foot and five-foot containers performed well with no failures.

Fourthly, the containers underwent a 24-hour thermal stability test. Ten samples of each container were filled with 16-ounces of carbonated water (4 atm), capped, and placed in a chamber at 100° F. and 50% relative humidity for 24 hours. Afterwards, there was measured the overall height increase of the container, the diameter increase, the fill point drop and the base clearance change, all of which reflect the amount of creep undergone by the pressurized container. As shown in the following table, the four-foot container exhibited significantly less creep.

Fifthly, the containers underwent a stress crack failure test. One hundred samples of each container were filled with 16-ounces of carbonated water (4.5 atm), capped, and dipped into a solution of a stress crack agent. The containers were then stored in a chamber at 100° F. and 85% relative humidity for 14 days. A failure was visually determined as a leaking or a burst container. The four-foot container exhibited a significant reduction in stress crack failure.

| | FOUR-FOOT | FIVE-FOOT |
|---|---|---|
| Base weight | 6.5 gms | 6.9 gms |
| Burst pressure | 189 psi | 181 psi |
| Drop impact failures | 0 | 0 |
| 24-hour thermal stability | | |
| height increase | 1.2% | 1.3% |
| diameter increase | 1.5% | 1.7% |
| fill point drop | 0.265 in | 0.319 in |
| base clearance change | 0.042 in | 0.051 in |
| Stress crack failures | 40% | 61% |

EXAMPLES 2–4

The following are three additional examples of four-foot PET base designs according to this invention. Examples 2 and 3 have the truncated hemisphere base design of FIG. 11B and Example 4 has the modified hemisphere base design of FIG. 9B.

| | EXAMPLE 2 | EXAMPLE 3 | EXAMPLE 4 |
|---|---|---|---|
| Volume | 1 liter | 1.25 liter | 2.0 liter |
| R | 1.743 in | 1.855 in | 2.177 in |
| K | 1.150 | 1.093 | |
| KR | 2.004 in | 2.028 in | |
| $\Theta$ | | | 70° |
| $R_z$ | 0.143 R | 0.148 R | 0.154 R |
| $H_D$ | 0.115 R | 0.112 R | 0.115 R |
| $L_F$ | 0.75 R | 0.75 R | 0.75 R |
| $\Theta_F$ | 8° | 8° | 8.5° |
| $D_F$ | 27.5° | 26° | 25° |
| 2C | 20° | 26° | 20° |
| B | 70° | 64° | 70° |

Certain preferred ranges have been determined for the various dimensions of the leg and foot in the four-foot PET beverage bottle of this invention. A minimum dome height $H_D$ is required to allow for creep, while increasing $H_D$ makes it more difficult to form the leg and foot. $H_D$ is proportional to radius R (of the cylindrical panel portion) and preferably is in the range:

HD/R =0.08 to 0.20.

The distance $L_F$ is a function of N, $D_F$, $H_{CG}$ and $\theta_T$, and preferably is at least 0.60R and more preferably in the range:

$L_F$/R=0.60 to 0.80;

most preferred is an $L_F$=0.70R to 0.80R. The radius of the outer leg adjacent the foot $R_G$ (FIG. 14), must be large enough for ease of formability but should not be so large as to increase the amount of stretch unnecessarily and preferably is in the range:

$R_G/R$=0.10 to 0.20.

The foot width $W_F$ is preferably in the range:

$W_F/R$=0 (i.e., line contact) to 0.35.

The angular extent of the foot $D_F$ is preferably in the range:

$D_F$=160/N to 60/N;

where N=4 for a four-foot base $D_F$ is from about 12° to about 40°, and more preferably about 18° to about 35°. The angle $\theta_F$ which the foot makes with the supporting plane, which will decrease when the bottle is filled, preferably is in the range prior to filing:

$\theta_F$=0 to 15°.

Figure 26:
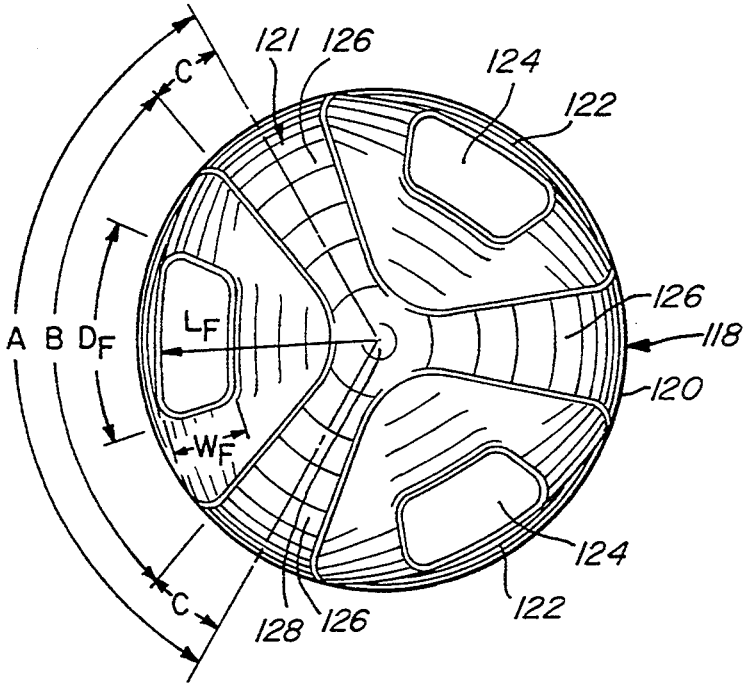
FIG. 26 is a bottom view of an alternative three-foot base configuration.

A still further embodiment of the invention is shown in FIG. 26—a three-foot base which may be incorporated into the two-liter PET beverage bottle previously described. The integral three-foot base 118 has a circumference 120 of diameter 4.45" (R=2.225"), and a substantially hemispherical bottom wall 121 with three symmetrically-spaced and downwardly projecting legs 122, each of which terminates in a lowermost foot 124. A rib wall 126 between each leg forms part of the substantially hemispherical bottom wall 121. A central dome 128 is defined by the junction of the ribs 126, and the feet 124 lie in a common horizontal plane. Similar to the nonmenclature used to describe the four-foot base in FIGS. 13–14, each rib 126 of the three-foot base has an angular extent 2C, and each foot as an angular extent $D_F$ and width $W_F$ and the outer edge of the foot 131 is spaced a horizontal distance $L_F$ from the center of the dome.

FIGS. 20–25 illustrate the balance of properties which may be obtained with a three-foot base design, and certain preferred ranges are set forth hereinafter. The circumferential angular extent (2C) of each rib wall is from about 16° to about 44°, more preferably from about 22° to about 38°, and still more preferably from about 27° to 32°, The circumferential angular extent ($D_F$) of the foot is from about 25° to about 80°, and more preferably from about 35° to about 50°. The distance $L_F$ is preferably in the range of 0.65R to 0.90R, and the foot width ($W_F$) is preferably in the range from 0 (i.e., line contact) to about 0.4R. In a specific embodiment, the rib angle (2C) is 30°, $D_F$ is 42° and $L_F$ is 0.8R. The minimum dome height ($H_D$) is preferably in the range of 0.08R to 0.20R. Preferably, the three-foot base incorporates the substantially hemispherical base designs of the prior embodiment having a straight line upper rib portion or a truncated base at the upper rib.

Although certain preferred embodiments of the invention have been specifically illustrated and described herein, it is to be understood that variations may be made without departing from the spirit and scope of the invention as defined by the appended claims. For example, the carbonated beverage bottle may be made in various other sizes (i.e., three-liter, one-liter, half-liter, 16-ounce 20-ounce, etc.), for which it may be desirable to vary the values of R, $L_F$, $D_F$, $T_R$, B, C, $\theta$, $\phi$, etc. Furthermore, containers other than bottles may be made, and from other plastic resins or other materials. It may be desirable to provide radial convolutions within the rib wall for greater strength, and the ribs may be of a constant width as opposed to being pie-shaped. Still further, it may be desirable in certain circumstances to utilize the improved container in conjunction with other packaging, such as a supporting member or base cup. Thus, all variations are to be considered as part of this invention when defined by the following claims.

What is claimed is:

1. A freestanding container having an improved combination of strength, stability and formability, the container being a hollow molded plastic body including a substantially cylindrical sidewall defined by a vertical centerline and having a radius R, and an integral base, the base including a bottom wall with a plurality of radial ribs, and legs extending downwardly from the bottom wall between the ribs and each terminating in a lowermost supporting foot, the improvement comprising:

the bottom wall being a continuous smooth surface free of stress concentrations and being substantially hemispherical with four radial ribs symmetrically positioned about the vertical centerline, each rib having a rib wall which is part of the substantially hemispherical bottom wall and having an average angular extent of from about 15° to about 30° to provide enhanced strength;

each leg occupying the remaining angular extent between each rib wall of from about 75° to about 60° to provide enhanced formability; and each foot having an outer edge radially disposed a distance $L_F$ of at least about 0.60R from the vertical centerline and an angular extent $D_F$ of from about 12° to about 40° to provide enhanced stability.

2. The container of claim 1, wherein the average angular extent of each rib wall is from about 20° to about 25°.

3. The container of any one of claims 1 and 2, wherein each leg has an inner leg wall extending between an innermost radial edge of the foot and a central portion of the bottom wall, the inner leg wall being a continuous and substantially smooth surface which is at an acute angle to a common plane on which the feet reside.

4. The container of claim 3, wherein the acute angle is of from about 10° to about 60°.

5. The container of claim 4, wherein the acute angle is of from about 15° to about 30°.

6. The container of claim 3, wherein the outer edge of the foot is formed by a radius $R_G$ and $L_F$ is defined at a point G' at which a vertical line from the center of radius $R_G$ intersects the foot, and wherein $L_F$ is of from about 0.60R to about 0.80R and $R_G$ is of from about 0.10R to about 0.20R.

7. The container of claim 3, wherein the substantially hemispherical bottom wall has a lowermost central dome point disposed at a distance $H_D$ above a common plane on which the feet reside and where $H_D$ is of from about 0.08R to about 0.20R.

8. The container of claim 3, wherein each foot has a radial width $W_F$ between an amount sufficient to establish line contact and up to about 0.35R.

9. The container of claim 3, wherein $D_F$ is from about 18° to about 35°.

10. The container of claim 1, wherein the container is a carbonated beverage container.

11. The container of claim 1, wherein the container body is made of a biaxially-oriented plastic.

12. The container of claim 11, wherein the plastic is selected from the group consisting of polyester, and acrylonitrile.

13. The container of claim 12, wherein the plastic is polyester.

14. The container of claim 13, wherein the plastic is a homopolymer or copolymer of polyethylene terephthalate.

15. The container of claim 14, wherein the container body has a two-liter volume and weighs no more than about 54 grams.

16. The container of claim 3, wherein the rib wall in radial cross section is a substantially straight line.

17. The container of claim 16, wherein the rib wall in radial cross section is slightly bowed outwardly.

18. The container of claim 16, wherein the rib wall in radial cross section is slightly bowed inwardly.

19. The container of claim 1, wherein the substantially hemispherical bottom wall provides a reduced base height compared to a pure hemispherical bottom wall.

20. The container of claim 19, wherein the substantially hemispherical bottom wall includes a lower pure hemispherical portion and an upper substantially straight line portion in vertical cross section.

21. The container of claim 20, wherein the cylindrical sidewall has a radius R of no greater than about 1.5 inches, and the substantially straight line portion begins at an angle $\theta$ of about 35° to about 70° from the vertical centerline.

22. The container of claim 20, wherein the cylindrical sidewall has a radius R of at least about 1.5 inches, and the substantially straight line portion begins at an angle $\theta$ of about 50° to about 70° from the vertical centerline.

23. The container of claim 20 adapted for holding a carbonated beverage which is carbonated to at least 4 atm, and wherein the substantially straight line portion begins at an angle $\theta$ of least about 70° from the vertical centerline.

24. The container of claim 1, wherein the substantially hemispherical bottom wall is a truncated hemisphere having a radius KR where $K>1$, in order to reduce the height of the base compared to a purely hemispherical bottom wall.

25. The container of claim 24, wherein R is no greater than about 1.5 inches and the truncated hemisphere extends from the vertical centerline to an angle $\phi$ of from about 50° to about 80°.

26. The container of claim 24, wherein R is at least about 1.5 inches and the truncated hemisphere extends upwardly from the vertical centerline to an angle $\phi$ of about 65° to about 80°.

27. A container comprising:

a hollow plastic blow-molded body having an open top end, a substantially cylindrical sidewall, and a closed integral base, the sidewall being defined by a vertical centerline and a radius R;

the base having a continuous and smooth bottom wall free of stress concentrations and being substantially hemispherical with four radiating ribs symmetrically positioned about the vertical centerline, and four legs extending downwardly from the bottom wall between the ribs and each terminating in a lowermost supporting foot;

each rib having a rib wall which is part of the substantially hemispherical bottom wall and having an average angular extent of from about 15° to about 30°;

each leg occupying the remaining angular extent between each rib wall of from about 75° to about 60°;

each foot having an outer edge radially disposed a distance $L_F$ of from about 0.60R to about 0.80R from the vertical centerline; each foot having an angular extent $D_F$ of from about 12° to about 40°;

each foot having a radial width $W_F$ between an amount sufficient to establish line contact and up to about 0.35R;

the bottom wall having a lowermost central point disposed at a distance $H_D$ above a common plane on which the feet reside of from about 0.08R to about 0.20R; and each leg having an inner leg wall extending between an innermost radial edge of the foot and a central portion of the bottom wall, the inner leg wall being a continuous and substantially smooth surface which is upwardly inclined at an acute angle to a common plane on which the feet reside.

28. A method of making a freestanding container base having an improved combination of strength, stability and formability, the container being a hollow blow-molded plastic body including a substantially cylindrical sidewall defined by a vertical centerline and having a radius R, and an integral base, the base including a bottom wall with a plurality of radial ribs, and legs extending downwardly from the bottom wall between the ribs and each terminating in a lowermost supporting foot, the method comprising the steps of:

providing the base with a substantially hemispherical bottom wall, the bottom wall being a continuous smooth surface free of stress concentrations;

providing four ribs and placing each of the four ribs in a separate quadrant of the bottom wall to form four symmetrical ribs about the vertical centerline, each rib having a rib wall which is part of the substantially hemispherical bottom wall and having an average angular extent of from about 15° to about 30° to provide enhanced strength;

providing a leg between each rib wall to occupy the remaining angular extent of from about 75° to about 60° to provide enhanced formability; and providing a foot having an outer edge radially disposed a distance $L_F$ of from about 0.60R to about 0.80R from the vertical centerline and an angular extent $D_F$ of from about 12° to about 40° to provide enhanced stability.

29. The method of claim 28, further comprising:

providing a lowermost central dome point of the substantially hemispherical bottom wall at a distance $H_D$ from a common plane on which the feet reside, wherein $H_D$ is from about 0.08R to about 0.20R.

30. The method of claim 29, further comprising:

providing a radial foot width $W_F$ between an amount sufficient to establish line contact and up to about 0.35R.

31. The method of claim 30, further comprising:

providing a reduced base height, compared to a pure hemispherical base of radius R, by providing a lower pure hemispherical portion and an upper substantially straight line portion extending from an angle $\theta$ of at least about 35° from the vertical centerline to the sidewall.

32. The method of claim 30, further comprising:

providing a reduced base height, compared to a pure hemispherical base of radius R, by providing a truncated hemispherical surface of radius KR where $K>1$.

* * * * *

UNITED STATES PATENT AND TRADEMARK OFFICE

CERTIFICATE OF CORRECTION

PATENT NO. : 5,427,258

DATED : June 27, 1995

INVENTOR(S) : Krishnakumar et al.

It is certified that error appears in the above-indentified patent and that said Letters Patent is hereby corrected as shown below:

Col. 2 , line 37 - delete "looted" and substitute -- footed --.

Col. 9 , line 64 - ~~before~~ paragraph insert the heading
-- 2. Design of the Basic or Bottom End Shape --

Col. 9 , line 65 - delete "looted" and substitute -- footed --.

Col. 14 , line 30 - delete "8" and substitute -- $\Theta$ --

Col. 13 , line 3 - delete the present formula and substitute the following:

$$\Psi_L = N(2C + K_L)$$
$$= (T_R + NK_L)$$

Signed and Sealed this

Third Day of October, 1995

*Attest:*

Bruce Lehman

BRUCE LEHMAN

*Attesting Officer*

*Commissioner of Patents and Trademarks*